US008308549B2

(12) United States Patent
Baerlocher et al.

(10) Patent No.: US 8,308,549 B2
(45) Date of Patent: Nov. 13, 2012

(54) GAMING SYSTEM AND METHOD FOR ADJUSTING THE AVERAGE EXPECTED PAYBACK ASSOCIATED WITH A PLAY OF A WAGERING GAME

(75) Inventors: Anthony J. Baerlocher, Reno, NV (US); Daniel J. Dewaal, Las Vegas, NV (US)

(73) Assignee: IGT, Reno, NV (US)

( * ) Notice: Subject to any disclaimer, the term of this patent is extended or adjusted under 35 U.S.C. 154(b) by 1004 days.

(21) Appl. No.: 12/271,325

(22) Filed: Nov. 14, 2008

(65) Prior Publication Data

US 2010/0124971 A1 May 20, 2010

(51) Int. Cl.
*A63F 9/24* (2006.01)

(52) U.S. Cl. ..... 463/20; 463/25; 463/30; 463/31

(58) Field of Classification Search ..... 463/20, 463/25, 30, 31

See application file for complete search history.

(56) References Cited

U.S. PATENT DOCUMENTS

| | | | |
|---|---|---|---|
| 4,743,022 | A | 5/1988 | Wood |
| 5,019,973 | A | 5/1991 | Wilcox et al. |
| 5,025,372 | A | 6/1991 | Burton et al. |
| 5,248,142 | A | 9/1993 | Breeding |
| 5,259,613 | A | 11/1993 | Marnell, II |
| 5,324,035 | A | 6/1994 | Morris et al. |
| 5,393,067 | A | 2/1995 | Paulsen et al. |
| 5,429,361 | A | 7/1995 | Raven et al. |
| 5,470,079 | A | 11/1995 | LeStrange et al. |
| 5,788,574 | A | 8/1998 | Ornstein et al. |
| 5,839,730 | A | 11/1998 | Pike |
| 5,876,284 | A | 3/1999 | Acres et al. |
| 5,910,048 | A | 6/1999 | Feinberg |
| 6,021,362 | A | 2/2000 | Maggard et al. |
| 6,077,163 | A | 6/2000 | Walker et al. |
| 6,146,273 | A | 11/2000 | Olsen |
| 6,149,521 | A | 11/2000 | Sanduski |
| 6,159,097 | A | 12/2000 | Gura |
| 6,186,893 | B1 | 2/2001 | Walker et al. |
| 6,186,894 | B1 | 2/2001 | Mayeroff |
| 6,210,275 | B1 | 4/2001 | Olsen |
| 6,217,448 | B1 | 4/2001 | Olsen |
| 6,224,483 | B1 | 5/2001 | Mayeroff |
| 6,227,969 | B1 | 5/2001 | Yoseloff |

(Continued)

FOREIGN PATENT DOCUMENTS

AU 200245837 B2 12/2002

(Continued)

*Primary Examiner* — Paul A. D'Agostino
*Assistant Examiner* — Brandon Gray
(74) *Attorney, Agent, or Firm* — Neal, Gerber & Eisenberg LLP

(57) ABSTRACT

A gaming system and method which provides a player with a higher average expected payback for making a gaming system wager on a gaming system wagering event in addition to making a primary game wager on a primary game. If the player places the gaming system wager on the gaming system wagering event, the player obtains the chance to win a gaming system award in addition to the player's chance of winning an award based on the outcome of the primary game, wherein the gaming system award is based, at least in part, on the primary game outcome. By placing a gaming system wager on the gaming system wagering event, the overall average expected payback associated with the play of the game increases, without changing the average expected payback of the primary game.

24 Claims, 22 Drawing Sheets

U.S. PATENT DOCUMENTS

| | | | | |
|---|---|---|---|---|
| 6,231,442 | B1 | 5/2001 | Mayeroff | |
| 6,254,483 | B1 | 7/2001 | Acres | |
| 6,257,981 | B1 | 7/2001 | Acres et al. | |
| 6,319,127 | B1 | 11/2001 | Walker et al. | |
| 6,358,147 | B1 | 3/2002 | Jaffe et al. | |
| 6,364,768 | B1 | 4/2002 | Acres et al. | |
| 6,390,917 | B1 | 5/2002 | Walker et al. | |
| 6,425,823 | B1 | 7/2002 | Byrne | |
| 6,471,208 | B2 | 10/2002 | Yoseloff et al. | |
| 6,517,073 | B1 | 2/2003 | Vancura | |
| 6,554,704 | B2 | 4/2003 | Nicastro et al. | |
| 6,589,115 | B2 | 7/2003 | Walker et al. | |
| 6,607,195 | B2 | 8/2003 | Vancura | |
| 6,612,927 | B1 | 9/2003 | Slomiany et al. | |
| 6,659,461 | B2 | 12/2003 | Yoseloff et al. | |
| 6,702,289 | B1 | 3/2004 | Feola | |
| 6,729,961 | B1 | 5/2004 | Millerschone | |
| 6,758,749 | B2 | 7/2004 | Krintzman | |
| 6,769,986 | B2 | 8/2004 | Vancura | |
| 6,866,584 | B2 | 3/2005 | Michaelson | |
| 6,877,745 | B1 | 4/2005 | Walker et al. | |
| 6,890,256 | B2 | 5/2005 | Walker et al. | |
| 6,926,607 | B2 | 8/2005 | Slomiany et al. | |
| 6,988,946 | B2 | 1/2006 | Michaelson et al. | |
| 7,004,834 | B2 | 2/2006 | Walker et al. | |
| 7,029,395 | B1 | 4/2006 | Baerlocher | |
| 7,077,745 | B2 | 7/2006 | Gomez et al. | |
| 7,094,149 | B2 | 8/2006 | Walker et al. | |
| 7,128,652 | B1 | 10/2006 | Lavoie et al. | |
| 7,137,883 | B1 | 11/2006 | Falciglia, Sr. | |
| 7,137,886 | B2 | 11/2006 | Locke et al. | |
| 7,140,964 | B2 | 11/2006 | Walker et al. | |
| 7,156,739 | B2 | 1/2007 | Walker et al. | |
| 7,192,348 | B2 | 3/2007 | Brosnan et al. | |
| 7,204,756 | B2 | 4/2007 | Jubinville et al. | |
| 7,275,990 | B2 | 10/2007 | Walker et al. | |
| 7,291,066 | B2 | 11/2007 | Gauselmann | |
| 7,291,069 | B2 | 11/2007 | Michaelson et al. | |
| 7,329,179 | B2 | 2/2008 | Baerlocher | |
| 7,329,183 | B2 | 2/2008 | Michaelson et al. | |
| 7,387,568 | B2 | 6/2008 | Millerschone | |
| 7,390,258 | B2 | 6/2008 | Millerschone | |
| 7,393,276 | B2 | 7/2008 | Millerschone | |
| 7,399,227 | B2 | 7/2008 | Michaelson et al. | |
| 7,419,431 | B2 | 9/2008 | Gauselmann et al. | |
| 7,458,889 | B2 | 12/2008 | Gauselmann | |
| 7,727,069 | B1 * | 6/2010 | Nelson | 463/31 |
| 2003/0199294 | A1 | 10/2003 | Walker et al. | |
| 2003/0207713 | A1 | 11/2003 | Taylor | |
| 2004/0038733 | A1 | 2/2004 | Walker et al. | |
| 2004/0063489 | A1 | 4/2004 | Crumby | |
| 2004/0147308 | A1 | 7/2004 | Walker et al. | |
| 2004/0219969 | A1 | 11/2004 | Casey et al. | |
| 2004/0224770 | A1 | 11/2004 | Wolf et al. | |
| 2005/0054429 | A1 | 3/2005 | Baerlocher et al. | |
| 2005/0060050 | A1 | 3/2005 | Baerlocher | |
| 2005/0096123 | A1 | 5/2005 | Cregan et al. | |
| 2005/0113161 | A1 | 5/2005 | Walker et al. | |
| 2005/0130737 | A1 * | 6/2005 | Englman et al. | 463/25 |
| 2005/0137012 | A1 | 6/2005 | Michaelson | |
| 2005/0148385 | A1 | 7/2005 | Michaelson | |
| 2005/0215311 | A1 * | 9/2005 | Hornik et al. | 463/20 |
| 2005/0277458 | A1 | 12/2005 | Wishart | |
| 2006/0040725 | A1 | 2/2006 | Walker et al. | |
| 2006/0046816 | A1 | 3/2006 | Walker et al. | |
| 2006/0052148 | A1 | 3/2006 | Blair et al. | |
| 2006/0063578 | A1 | 3/2006 | Bansemer et al. | |
| 2006/0094509 | A1 | 5/2006 | Michaelson et al. | |
| 2006/0105836 | A1 | 5/2006 | Walker et al. | |
| 2006/0111172 | A1 | 5/2006 | Walker et al. | |
| 2006/0172791 | A1 | 8/2006 | Wolf | |
| 2006/0202415 | A1 | 9/2006 | Taylor | |
| 2006/0217190 | A1 | 9/2006 | Walker et al. | |
| 2006/0223629 | A1 | 10/2006 | Walker et al. | |
| 2006/0223630 | A1 | 10/2006 | Walker et al. | |
| 2006/0226596 | A1 | 10/2006 | Walker et al. | |
| 2006/0226597 | A1 | 10/2006 | Walker et al. | |
| 2006/0247029 | A1 | 11/2006 | Walker et al. | |
| 2006/0247032 | A1 | 11/2006 | Walker et al. | |
| 2006/0252515 | A1 | 11/2006 | Walker et al. | |
| 2006/0258422 | A1 | 11/2006 | Walker et al. | |
| 2006/0287040 | A1 | 12/2006 | Walker et al. | |
| 2006/0287071 | A1 | 12/2006 | Walker et al. | |
| 2007/0004502 | A1 | 1/2007 | Walker et al. | |
| 2007/0004503 | A1 | 1/2007 | Walker et al. | |
| 2007/0004504 | A1 | 1/2007 | Walker et al. | |
| 2007/0026924 | A1 | 2/2007 | Taylor | |
| 2007/0032285 | A1 | 2/2007 | Wolf | |
| 2007/0060252 | A1 | 3/2007 | Taylor | |
| 2007/0077978 | A1 | 4/2007 | Walker et al. | |
| 2007/0117612 | A1 | 5/2007 | Walker et al. | |
| 2007/0155480 | A1 | 7/2007 | Brosnan et al. | |
| 2007/0254732 | A1 | 11/2007 | Walker et al. | |
| 2008/0020847 | A1 | 1/2008 | Kniesteadt et al. | |
| 2008/0051169 | A1 | 2/2008 | Michaelson et al. | |
| 2008/0064491 | A1 | 3/2008 | Taylor | |
| 2008/0096650 | A1 | 4/2008 | Baerlocher | |
| 2008/0108423 | A1 | 5/2008 | Benbrahim et al. | |
| 2008/0113763 | A1 | 5/2008 | Michaelson et al. | |
| 2008/0214263 | A1 | 9/2008 | Walker et al. | |
| 2008/0214292 | A1 | 9/2008 | Bryant et al. | |
| 2009/0104954 | A1 | 4/2009 | Weber et al. | |

FOREIGN PATENT DOCUMENTS

| | | | |
|---|---|---|---|
| AU | 771847 | | 4/2004 |
| DE | 3105266 | C2 | 9/1982 |
| EP | 0 558 307 | A2 | 2/1993 |
| EP | 753 331 | A2 | 1/1997 |
| EP | 874 337 | A1 | 10/1998 |
| EP | 0 981 119 | A2 | 2/2000 |
| EP | 1 076 321 | A1 | 2/2001 |
| EP | 1 195 730 | A2 | 4/2002 |
| EP | 1 536 388 | A1 | 1/2005 |
| EP | 1 513 114 | A2 | 3/2005 |
| EP | 1 580 701 | A2 | 3/2005 |
| GB | 2 137 392 | A | 10/1984 |
| GB | 2 292 245 | | 2/1996 |
| GB | 2 322 217 | A | 8/1998 |
| GB | 2 382 911 | | 6/2003 |
| GB | 2 387 950 | A | 10/2003 |
| WO | WO 85/00910 | | 2/1985 |
| WO | WO 03/026757 | | 4/2003 |
| WO | WO 2005/083599 | A1 | 9/2005 |
| WO | WO 2006/015442 | A1 | 2/2006 |
| WO | WO 2006/017431 | | 2/2006 |
| WO | WO 2007/090270 | | 8/2007 |

* cited by examiner

FIG. 4A

300a

| Gaming system wagering opportunities | Gaming system wager (credits) | Range of multipliers |
|---|---|---|
| 94d | 10 (i.e., 1/2 the primary game wager) | 1X - 5X |
| 94c | 20 (i.e., equal to the primary game wager) | 1X - 8X |
| 94b | 40 (i.e., 2 times the primary game wager) | 2X - 10X |
| 94a | 80 (i.e., 4 times the primary game wager) | 4X - 10X |

FIG. 4B

300b

| Primary Game Wager Placed (credits) | Gaming System Wager associated with the "1/2x Gaming System Wagering Opportunity" (Credits) | Multiplier Table employed by Central Server to determine Gaming System Multiplier | Average gaming System Multiplier determined based on employed Multiplier Table | Average Expected Payback if no gaming system wager is placed (%) | Average Expected Payback if gaming system wager is placed (%) |
|---|---|---|---|---|---|
| 20 | 10 | A | 1.625X | 85 | 92.1 |
| 40 | 20 | B | 1.65X | 85 | 93.5 |
| 60 | 30 | C | 1.675X | 85 | 94.9 |
| 100 | 50 | D | 1.7X | 85 | 96.3 |
| 200 | 100 | E | 1.725X | 85 | 97.8 |

FIG. 4C

300c

Multiplier Table A

| Multipliers in the range of multipliers associated with the 1/2x gaming system wagering opportunity | Probability of being selected by the central server |
|---|---|
| 1X | 60% |
| 2X | 25% |
| 3X | 10% |
| 4X | 2.5% |
| 5X | 2.5% |

Average Multiplier for Multiplier Table A = 1.625X

FIG. 4D

300d

Multiplier Table E

| Multipliers in the range of multipliers associated with the 1/2x gaming system wagering opportunity | Probability of being selected by the central server |
|---|---|
| 1X | 55% |
| 2X | 27.5% |
| 3X | 10% |
| 4X | 5% |
| 5X | 2.5% |

Average Multiplier for Multiplier Table E = 1.725X

FIG. 4E

300e

| Primary game wager placed (credits) | Gaming system wager placed (credits) | Average multiplier determined by central server | Average Expected Payback if no gaming system wager is placed (%) | Average Expected Payback if gaming system wager is placed (%) |
|---|---|---|---|---|
| 20 | 10 (i.e., 1/2 the primary game wager) | 1.625X | 85 | 92.1 |
| 20 | 20 (i.e., equal to the primary game wager) | 2.2X | 85 | 93.5 |
| 20 | 40 (i.e., 2 times the primary game wager) | 3.35X | 85 | 94.9 |
| 20 | 80 (i.e., 4 times the primary game wager) | 5.6X | 85 | 95.2 |

FIG. 4F

300f

| Primary game wager placed (credits) | Gaming system wager placed (credits) | Average multiplier determined by central server | Average Expected Payback if no gaming system wager is placed (%) | Average Expected Payback if gaming system wager is placed (%) |
|---|---|---|---|---|
| 200 | 100 (i.e., 1/2 the primary game wager) | 1.725X | 85 | 97.8 |
| 200 | 200 (i.e., equal to the primary game wager) | 2.31X | 85 | 98.2 |
| 200 | 400 (i.e., 2 times the primary game wager) | 3.475X | 85 | 98.5 |
| 200 | 800 (i.e., 4 times the primary game wager) | 5.825X | 85 | 99.0 |

FIG. 6

300g

| Primary Game Wager Placed | AEP if no gaming system wager is placed | AEP if gaming system wager placed is 1/2 the primary game wager placed | AEP if gaming system wager placed is equal to the primary game wager placed | AEP if gaming system wager placed is two times the primary game wager placed | AEP if gaming system wager placed is four times the primary game wager placed |
|---|---|---|---|---|---|
| 20 | 85% | 85.5% | 86% | 87% | 88% |
| 40 | 85% | 86% | 87% | 88% | 90% |
| 60 | 85% | 86.5% | 88% | 89.5% | 92% |
| 100 | 85% | 87% | 90% | 92% | 95% |
| 200 | 85% | 89% | 92% | 95% | 97% |

GAMING SYSTEM AND METHOD FOR ADJUSTING THE AVERAGE EXPECTED PAYBACK ASSOCIATED WITH A PLAY OF A WAGERING GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming devices which provide players awards in primary or base games are well known. Gaming devices generally require the player to place or make a wager to activate the primary or base game. In many of these gaming devices, the award is based on the player obtaining a winning symbol or symbol combination and based on the amount of the wager (e.g., the higher the wager, the higher the award). Symbols or symbol combinations which are less likely to occur usually provide higher awards.

In such known gaming devices, the amount of the wager made on the primary or base game by the player may vary. For instance, the gaming device enables the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game has one or more paylines and the gaming device enables the player to make a wager on each payline in a single play of the primary game. Slot games with 1, 3, 5, 9, 15 and 25 lines are widely commercially available. Thus, it is known that gaming devices enable players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. It should be appreciated that different players play at substantially different wagering amounts or levels.

Many known gaming devices have predetermined paytables which include a plurality of different predetermined winning symbols or winning symbol combinations and a plurality of different predetermined awards respectively associated with the predetermined winning symbols or winning symbol combinations for the wager placed. The paytable of a gaming device determines the award that a player wins if one of the predetermined winning symbols or winning symbol combinations occurs on an activated payline. Many paytables are also considered to include the probabilities of each of the winning symbols or winning symbol combinations occurring.

Each gaming device is typically configured to pay back, on average, a certain percentage of the amount of money wagered by players. The average percentage of money wagered that is expected to be paid back to the player as an award is sometimes called the average expected payback or average expected payback percentage. The average expected payback provided by a gaming device is determined at least in part by the paytable of the gaming device.

In general, although the actual payback may vary, the average expected payback for a gaming device is predetermined and remains constant as the wager levels increase. The awards associated with the winning symbol combinations of the gaming device's paytable typically increase as the wager increases in a linear manner. Many stand alone gaming devices have paytables which provide an enhanced top award (i.e., the highest number of credits to be paid out for a winning symbol combination) for making a maximum wager. This results in a higher average expected payback for making the maximum wager. Thus, in many gaming devices, for most wagers placed, the average expected payback provided by a gaming device is the same, except in the circumstances where a player is making the maximum wager.

Gaming devices are typically configured to have an average expected payback that is between 82% and 98%. The minimum average expected payback varies among jurisdictions and is typically established by law or regulation. A gaming device's average expected payback is typically set at the gaming device manufacturer's factory when the software for the gaming device is loaded, enabled, or configured.

One issue with such known gaming devices is that changing the average expected payback of a gaming device after that gaming device has been placed on a gaming establishment floor requires a physical modification or replacement of the software of the gaming device. Currently employed techniques for loading, modifying or replacing software in gaming devices are inconvenient, time-consuming and expensive. In such a situation, gaming operators must identify the gaming devices to receive the new software, locate the gaming devices, and temporarily shut down or remove the gaming devices from the gaming establishment floor. Service personnel must replace or modify the existing software of such gaming devices with the new software. Loading new software in gaming devices typically involves a large investment of time and effort by skilled personnel, and therefore results in relatively high expense. Each gaming establishment typically has hundreds or thousands of gaming devices, which are manufactured by various different gaming device manufacturers and which include a wide variety of different game configurations, versions and types. Thus, it is very difficult for gaming establishments to readily change or replace the software for all or a large number of their gaming devices. In addition, certain gaming regulations require that, if the average expected payout of a gaming device changes, a notification must be provided to the player playing at that gaming device, such as by changing the symbols of the gaming device.

It is known to provide server-based gaming systems where a central server provides game configurations or game software to the gaming devices of the gaming system. In certain server-based systems, game operators have the ability to change the average expected payback of a gaming device through the central server by swapping a first game program having a first paytable with a second game program having a paytable with a higher average expected payback. While this solves part of the problem, the gaming device manufacturers still need to provide the two different game programs with the two different paytables, and gaming establishments still need to purchase those specific games. Since each gaming device manufacturer's software is proprietary, it is difficult for one company to reconfigure or change the paytable of a game made by another company.

In general, low-denomination gaming devices have lower average expected paybacks. One issue with such low denomination gaming devices, such as penny gaming devices, is that regardless of whether a player is betting one penny or two hundred pennies, the average expected paypack does not change. Thus, players who are betting substantial amounts on low denomination gaming devices have the same average expected payback as players betting relatively small amounts.

Accordingly, there is a need to enable gaming establishments to offer players unique and customized game events that reward players for wagering at or above a designated level or for making certain bets in association with a play of a game. Such game events need to be provided in a way that does not burden gaming device manufacturers with having to develop an unreasonable amount of custom game programs or software for each different gaming establishment, and that does not burden gaming establishments with having to purchase and monitor many different game programs.

It is also known that gaming operators monitor the operation of gaming devices on the gaming establishment floor connected to a central server from a remote location (i.e., in a private area of the gaming establishment). This requires information to be communicated from each monitored gaming device to communicate information regarding wagers and game play to the central server on a regular basis. The communicated information typically includes wager amounts, payouts, time of play.

FIG. 3A generally illustrates one known gaming system which includes one or more gaming devices in communication with a central server. The gaming device enables a player to initiate a play of a primary game by making a primary game wager and forms primary game configuration data based on this as indicated by block 102. The primary game configuration data includes an amount of money a player has wagered on the primary game of the gaming device, a number of paylines activated, the type of game, a time the primary game was initiated, and a particular identification of the gaming device. The gaming device transmits a data packet 104 which includes the primary game configuration data to the central server. The central server receives the primary game configuration data as indicated by block 106. As indicated by block 108, the gaming device randomly generates and displays a primary game outcome. If the primary game outcome is a winning outcome, the gaming device determines an award based on the generated primary game outcome. The gaming device forms primary game outcome data based on the generated primary game outcome and any award as indicated by block 110. The gaming device transmits a data packet 112 which includes the primary game outcome data to the central server, and the central server receives the primary game outcome data as indicated by block 114. The gaming device adds a number of credits to a credit meter for any award won based on the primary game outcome as indicated by block 116.

There have been no commercially viable solutions to the aforementioned problems with known gaming devices and gaming systems. There is also a continuing need to provide new and different gaming devices and gaming systems, as well as new and different ways to provide awards to players.

SUMMARY

In various embodiments, the gaming system and method disclosed herein provides a player with a higher average expected payback for making a gaming system wager on a gaming system wagering event in addition to making a primary game wager on a primary game. By placing the gaming system wager on the gaming system wagering event, the player obtains the chance to win a gaming system award in addition to the player's existing chance of winning an award based on the outcome of the primary game, wherein the gaming system award is based, at least in part, on the primary game outcome.

The primary game has or is associated with a first paytable having a first average expected payback. The gaming system wagering event is associated with a second paytable having a second higher average expected payback. By making the gaming system wager on the gaming system wagering event, this enables increasing an overall average expected payback associated with the play of the primary game without modifying the paytable of the primary game of the gaming device. The gaming system wagering event of the present disclosure can thus sit on top of any primary game (or a large number of primary games) as a game overlay, without having to modify the software or code associated the primary game.

In one example configuration of the present disclosure, a central server is configured to communicate with a plurality of gaming devices. Each of the gaming devices of the gaming system includes one or more primary wagering games, which are locally controlled by a gaming device processor of the gaming device. In one embodiment, each of the gaming devices is configured to operate with the central server to enable a gaming system wagering event controlled by the central server to be output or displayed on the gaming device during a play of the primary wagering game. It should be appreciated that the gaming system wagering event occurs independently of the primary wagering game of the gaming device, such that it does not modify or affect the software of the primary wagering game.

In one embodiment, the gaming system wagering event provides a player playing the primary game of the gaming device with one or more opportunities to make a gaming system wager before a primary game outcome is generated or displayed. Each of these gaming system wagering opportunities enables the player to obtain a gaming system outcome for making a gaming system wager of a designated amount. The central server determines whether a gaming system award will be provided to the player based on the gaming system outcome. In one embodiment, each gaming system award is determined based, at least in part, on the primary game outcome generated by the gaming device. That is, the central server utilizes the primary game outcome and the gaming system outcome to determine the gaming system award. Thus, in such embodiments, for making a gaming system wager, the player obtains the chance to win a gaming system award which is determined remotely by the central server based, at least in part, on the outcome of the play of the primary game in addition to the player's existing chance of directly winning a primary game award for the play of the primary game.

In one embodiment, the gaming system wagering event is provided via an overlay window, a service window, or an interface under control of the central server. The service window is utilized to display the gaming system wagering opportunities of the gaming system wagering event from the primary game wagering opportunities and, in certain embodiments, to receive player inputs from input devices coupled to the gaming device, such as a touch screen. In these embodiments, a player playing at the gaming device can utilize the service window to input selections of the available gaming system wagering opportunities and/or to input the gaming system wager associated with any selected gaming system wagering opportunity. In one embodiment, the service window utilizes a portion of a main window of a display device of the gaming device. In one such embodiment, the service window is displayed adjacent to the main window of the display device. In such embodiments, the service window enables the player to view and/or make selections of the various available gaming system wagering opportunities in the gaming system wagering event while simultaneously viewing the primary game.

In operation of one embodiment of the present disclosure, a gaming device enables a player to initiate a play of the primary game by making a primary game wager which includes a number of wager components. For example, the wager components include a number of activated paylines and an amount wagered on each of those paylines. The gaming device forms primary game configuration data, which include one or more primary game characteristics, such as the type of game, the time the game was initiated, the wagering denomination, the number of activated paylines, the wager amount per payline, etc. The gaming device transmits a data packet which includes the primary game configuration data to the central server. The central server evaluates the primary game configuration data. In one embodiment, if the primary game configuration data meets a designated condition, level or threshold, the central server prepares one or more gaming system wagering opportunities for the gaming system wagering event. For example, the player's primary game wager must meet a designated wager level for the central server to prepare the gaming system wagering opportunities for the gaming system wagering event.

Each of the gaming system wagering opportunities that may be prepared (and subsequently offered to the player) for the gaming system wagering event enables the player to obtain a gaming system outcome for making a designated gaming system wager. In certain embodiments, the gaming system wagering opportunities offered to a player in the gaming system wagering event are determined based on the wager made by that player for the play of the primary game or other activity associated with play of the primary game. For example, if the player places a primary game wager of twenty credits, the available gaming system wagering opportunities enable the player to make a gaming system wager of ten, twenty, forty, sixty, or eighty credits.

After the central server prepares the gaming system wagering opportunities for the gaming system wagering event, the central server causes the gaming device to display the gaming system wagering opportunities. That is, the central server interrupts the play of the primary game between the configuration of the bet and the generation of a primary game outcome (such as before the reels spin or before any part of the outcome is displayed to the player) and causes the gaming device to display the gaming system wagering opportunities to the player. The central server causes the gaming device to enable the player to select one of the displayed gaming system wagering opportunities and to place the gaming system wager associated with the selected gaming system wagering opportunity.

If the player selects one of the displayed gaming system wagering opportunities and places the gaming system wager associated with that gaming system wagering opportunity, the central server communicates this to the gaming device and instructs the gaming device to proceed with primary game play. The gaming device causes the play of the primary game to occur and generates a primary game outcome. The gaming device determines whether to provide any primary game award based on the generated primary game outcome in accordance with the paytable employed by the gaming device. The gaming device transmits a data packet which includes primary game outcome data to the central server. The primary game outcome data include winning and losing primary game outcomes and any associated primary game awards for the play of the primary game.

If the player placed a gaming system wager, the central server determines a gaming system outcome. In one example embodiment, the central server determines the gaming system outcome by randomly selecting a gaming system modifier, such as a multiplier. The central server utilizes the primary game outcome and the gaming system outcome to determine a gaming system award. The gaming system award may result in an additional number of credits provided to the player in addition to any primary game award won. The central server communicates any gaming system award to the gaming device, and any additional credits owed to the player are added to the credit meter on the gaming device and subsequently displayed to the player. In this manner, wagering on the gaming system outcome causes a total average expected payback per credit wagered to increase.

Accordingly, the gaming system of the present disclosure provides players with gaming system wagering opportunities which can result in gaming system awards which are partially determined by a central server. In this manner, the system disclosed herein enables offering players the opportunity to obtain a higher average expected payback per credit wagered, without modifying the primary game or the gaming device. This system enables casinos to determine when to offer such opportunities and to which players. For example, casinos may offer these opportunities to certain players at certain times of the day.

The present disclosure thus provides a server-controlled game overlay which can be selectively offered to players and which can be used with existing wagering games (or a large number of existing wagering games) to enable changing the average expected payback associated with a play of that game. The server-controlled game overlay disclosed herein is configured to be delivered to many different types of gaming devices, which can include game software manufactured by different gaming device manufacturers, without having specific game software associated with each gaming device and/or without having to change or modify the game programs or paytables associated with such gaming devices.

Additional features and advantages are described herein, and will be apparent from the following Detailed Description and the figures.

BRIEF DESCRIPTION OF THE FIGURES

FIG. 4A provides a table summarizing the gaming system wagering opportunities that are available to a player in one example gaming system wagering event.

FIG. 4B provides a table showing the different multiplier tables employed by the central server to determine the gaming system multiplier in the example gaming system wagering event.

FIG. 4C provides a table representing an example multiplier table.

FIG. 4D provides a table representing another example multiplier table.

FIG. 4E provides a table which shows, for each gaming system wagering opportunity offered in the example gaming system wagering event, the average gaming system multiplier determined by the central server if a player has placed a primary game wager of a first amount.

FIG. 4F provides a table which shows, for each gaming system wagering opportunity offered in the example gaming system wagering event, the average gaming system multiplier determined by the central server if a player has placed a primary game wager of a second higher amount.

FIG. 6 provides a table illustrating how, in one example embodiment of the present disclosure, the average expected payback associated with a play of a primary game changes based on the primary game wager and the gaming system wager placed in association with the play of the primary game.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
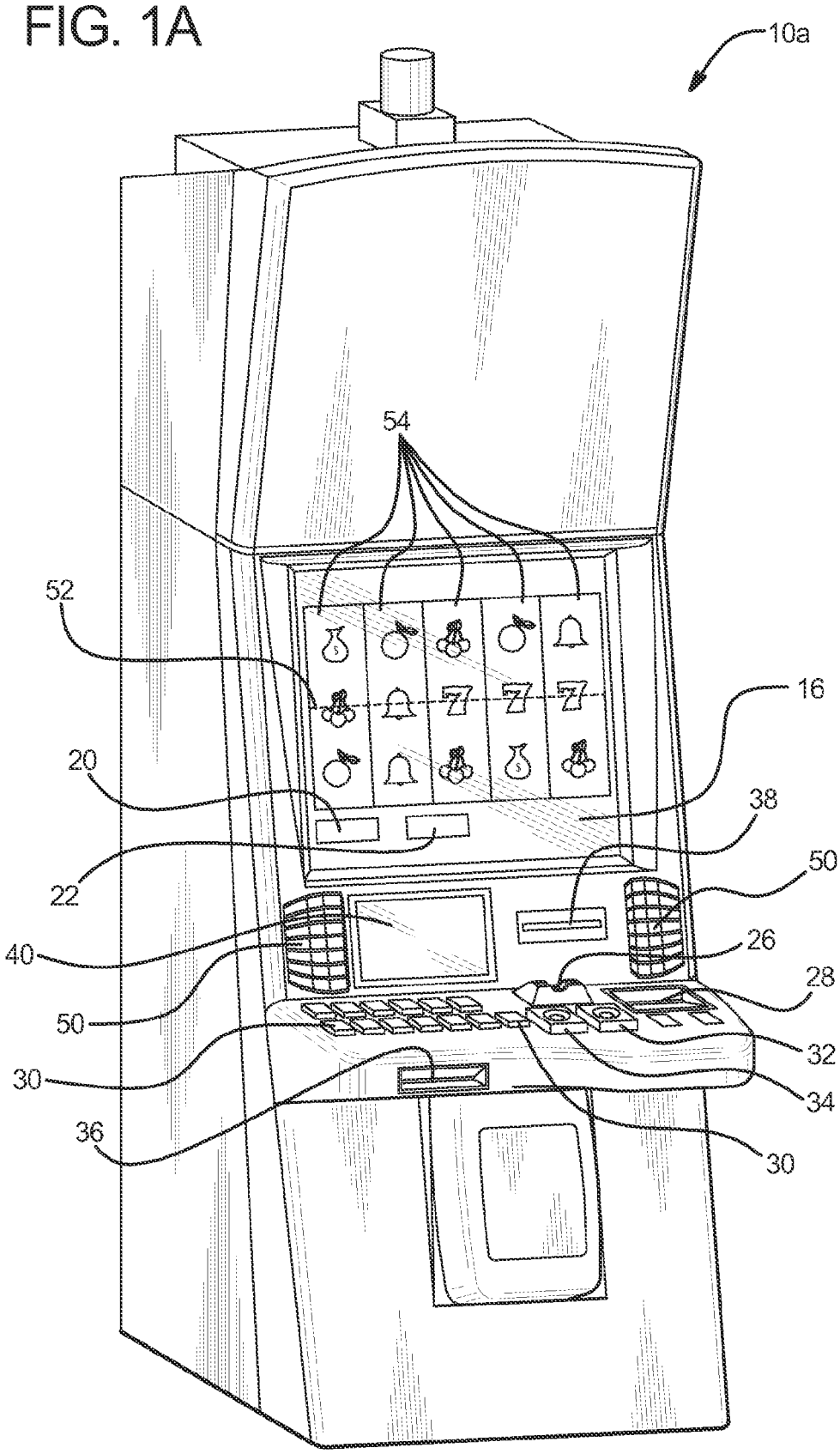
FIGS. 1A and 1B are perspective views of example alternative embodiments of a gaming device of the present disclosure.
Figure 1B:
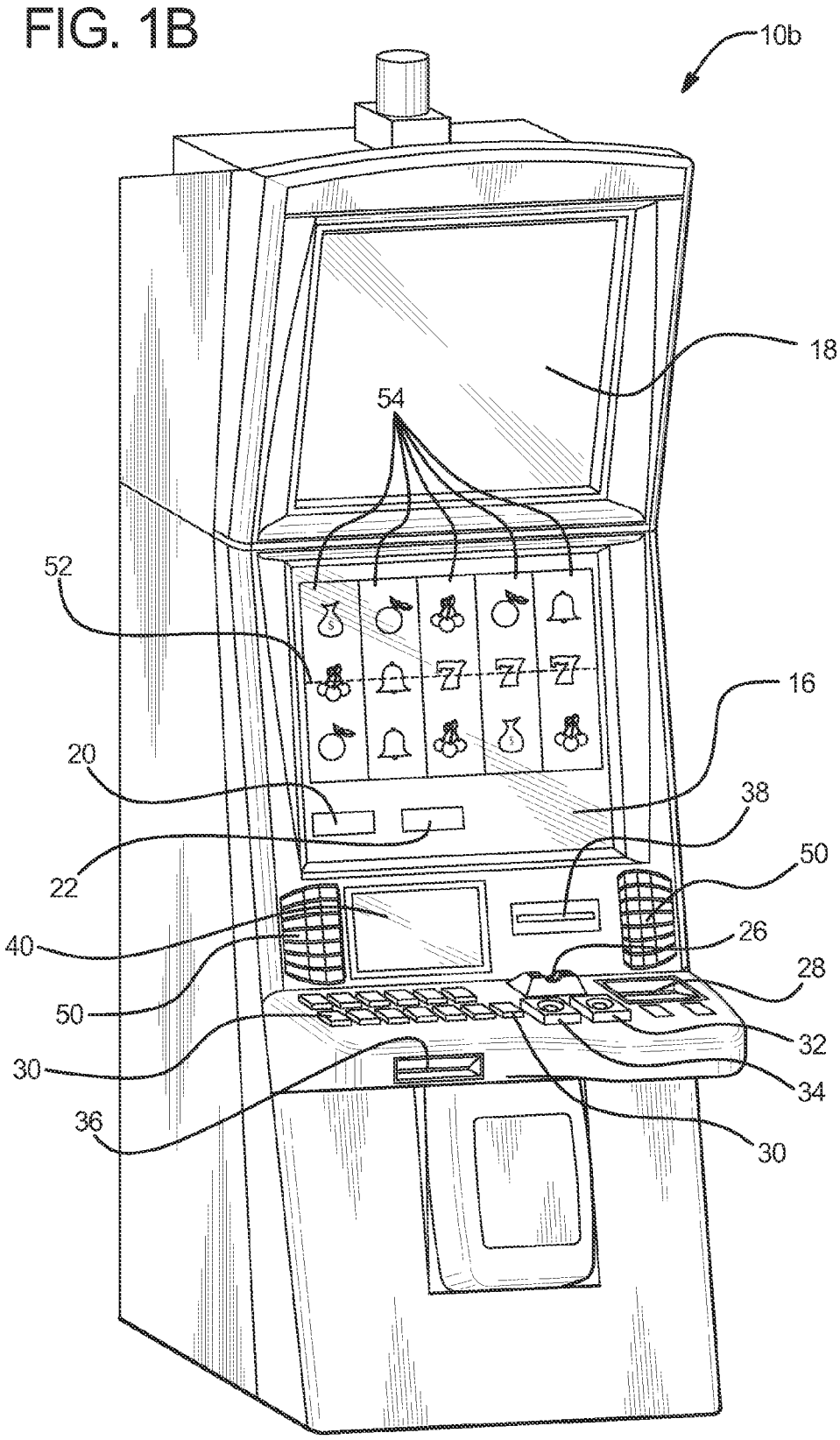

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
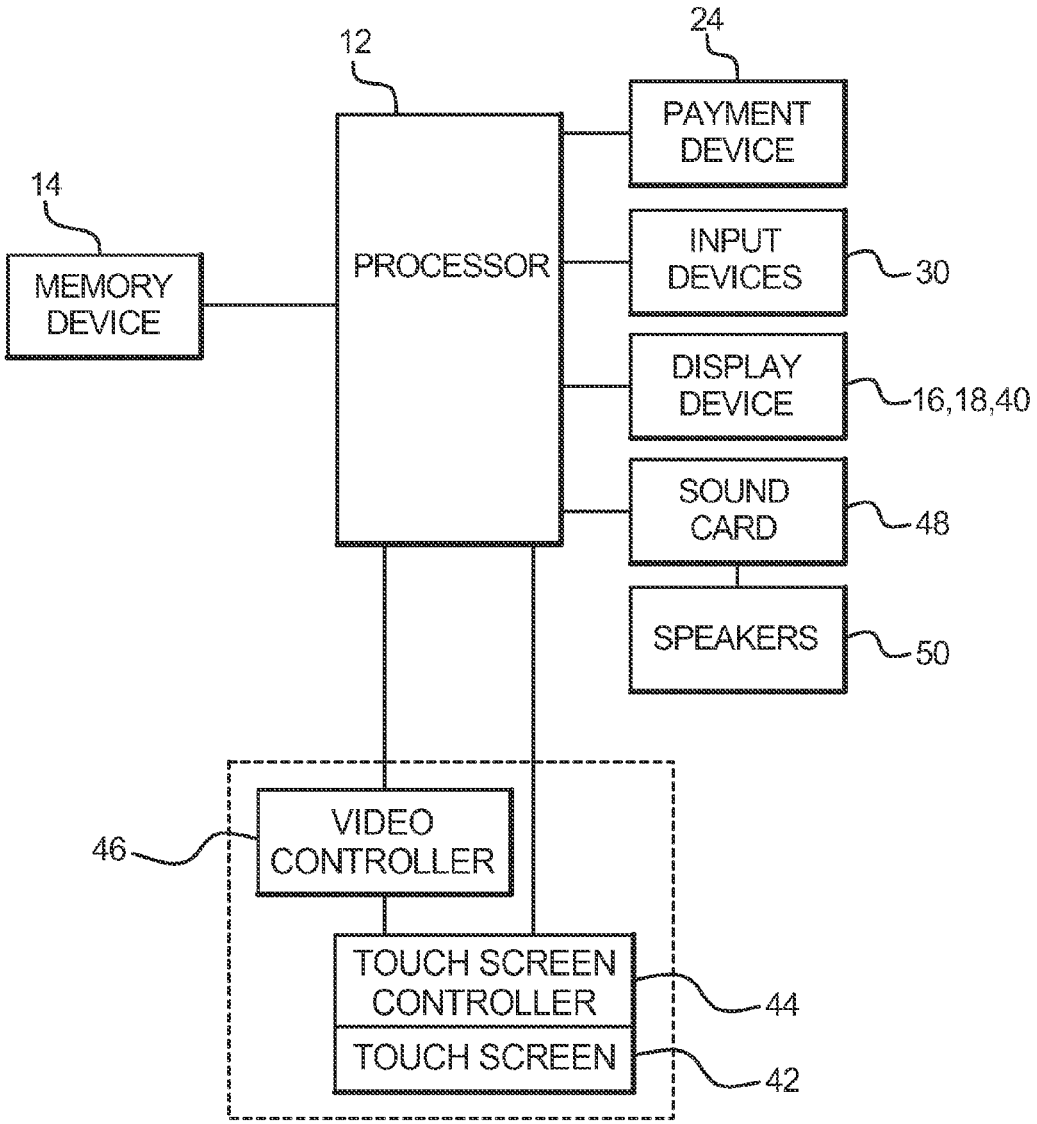
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. The display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary game. The gaming machine or device may include some or all of the features of conventional gaming machines or devices. The primary game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, as described below, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, if the player has not enrolled in the bonus event participation program (as described below), the gaming device processor 12 or central server 56 randomly provides the player one or more plays of one or more secondary games. In one such embodiment, the gaming device does not provide any apparent reasons to the player for qualifying to play a secondary game. In this embodiment, qualifying for a secondary game may not be triggered by an event in or based specifically on any of the plays of any primary game. The gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, if the player has not enrolled in the bonus event participation program (as described below), the gaming device includes a program which will automatically begin a secondary game after the player has achieved a triggering event or qualifying condition in the primary game. In another embodiment, after a player has qualified for a secondary game, the player may subsequently enhance his/her secondary game participation through continued play on the primary game. Thus, for each secondary game qualifying event, such as a secondary game symbol, that the player obtains, a given number of secondary game wagering points or credits may be accumulated in a "secondary game meter" programmed to accrue the secondary game wagering credits or entries toward eventual participation in a secondary game. The occurrence of multiple such secondary game qualifying events in the primary game may result in an arithmetic or exponential increase in the number of secondary game wagering credits awarded. In one embodiment, the player may redeem extra secondary game wagering credits during the secondary game to extend play of the secondary game.

In one embodiment, no separate entry fee or buy in for a secondary game need be employed. In this embodiment, a player may not purchase an entry into a secondary game, rather they must win or earn entry through play of the primary game thus, encouraging play of the primary game. In another embodiment, qualification of the secondary game is accomplished through a simple "buy in" by the player, for example, if the player has been unsuccessful at qualifying through other specified activities. In another embodiment, the player must make a separate side-wager on the secondary game or wager a designated amount in the primary game to qualify for the secondary game. In this embodiment, the secondary game triggering event must occur and the side-wager (or designated primary game wager amount) must have been placed to trigger the secondary game.

Figure 2B:
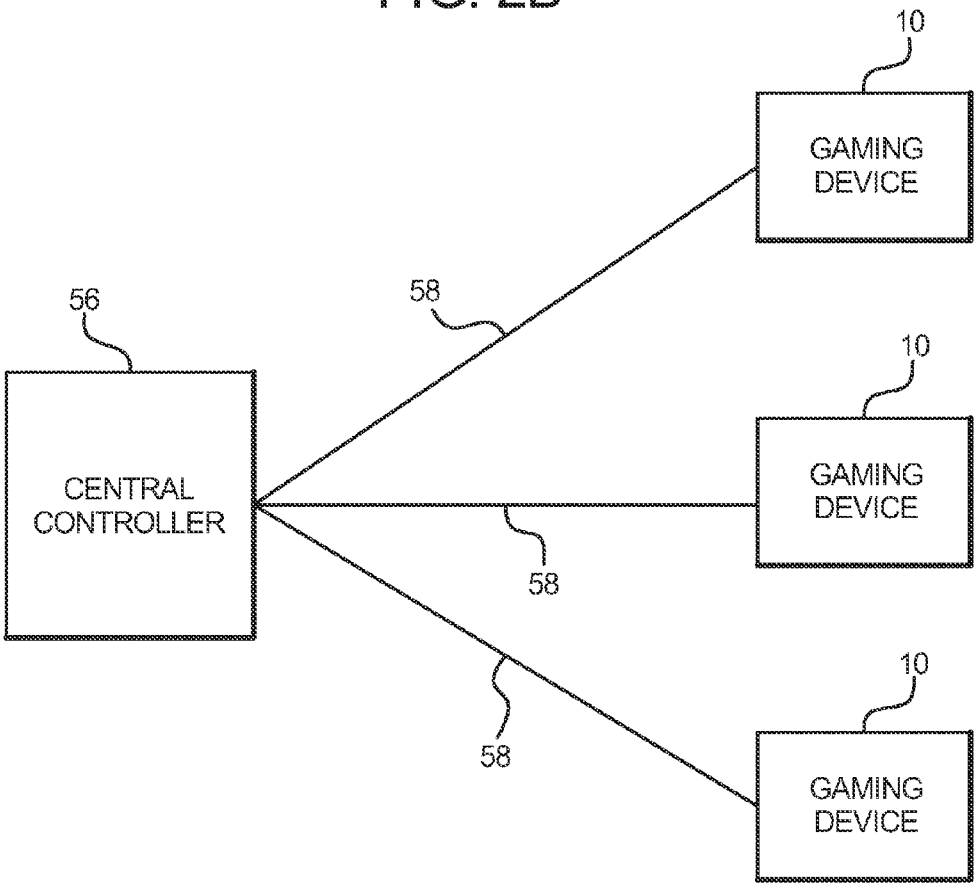
FIG. 2B is a schematic block diagram of one embodiment of a network configuration for a plurality of gaming devices disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Gaming System Wagering Event Example Embodiment

Figure 3A:
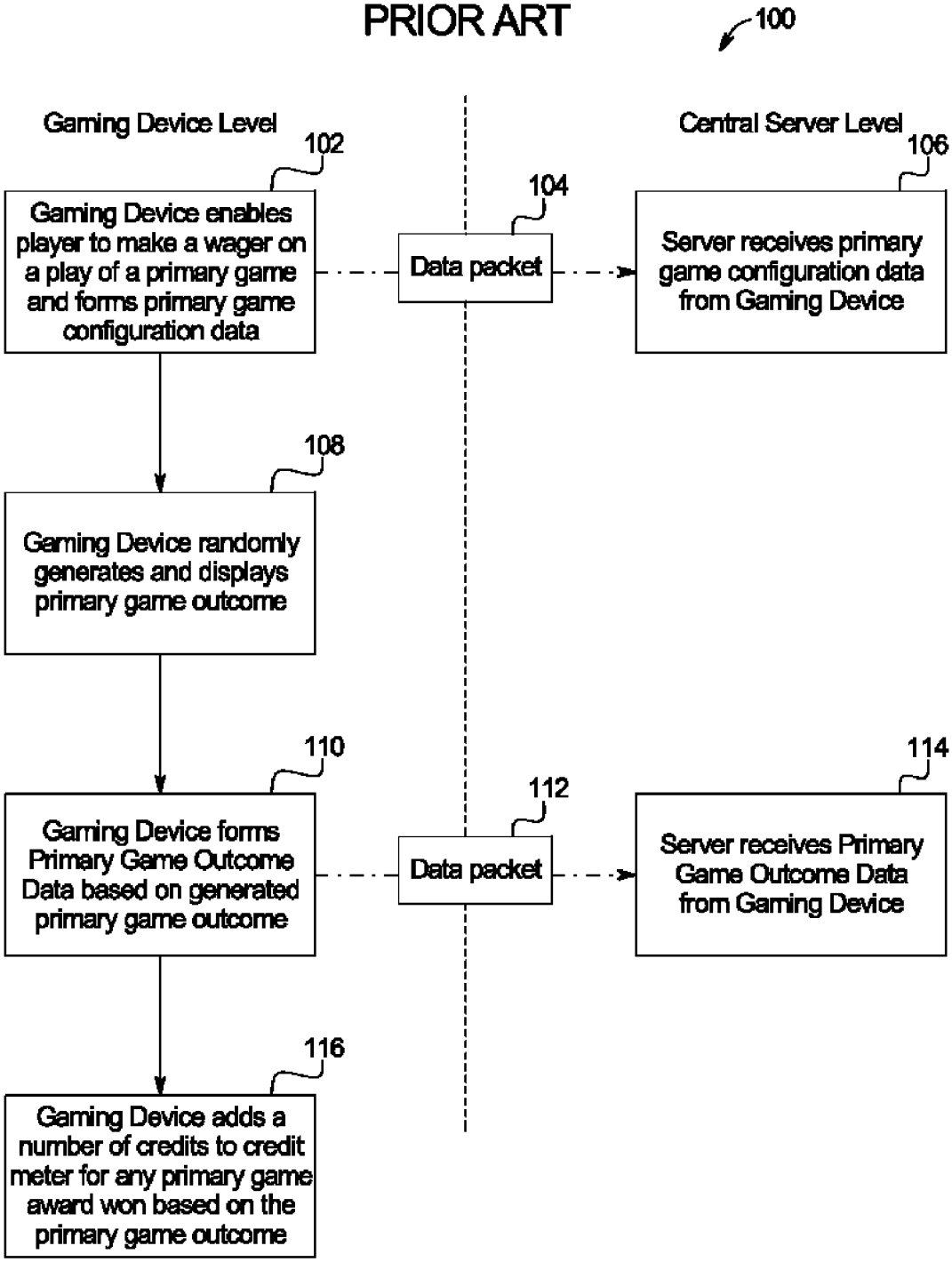
FIG. 3A PRIOR ART
FIG. 3A is a process flow diagram showing a flow sequence of a prior art gaming system.
Figure 3B:
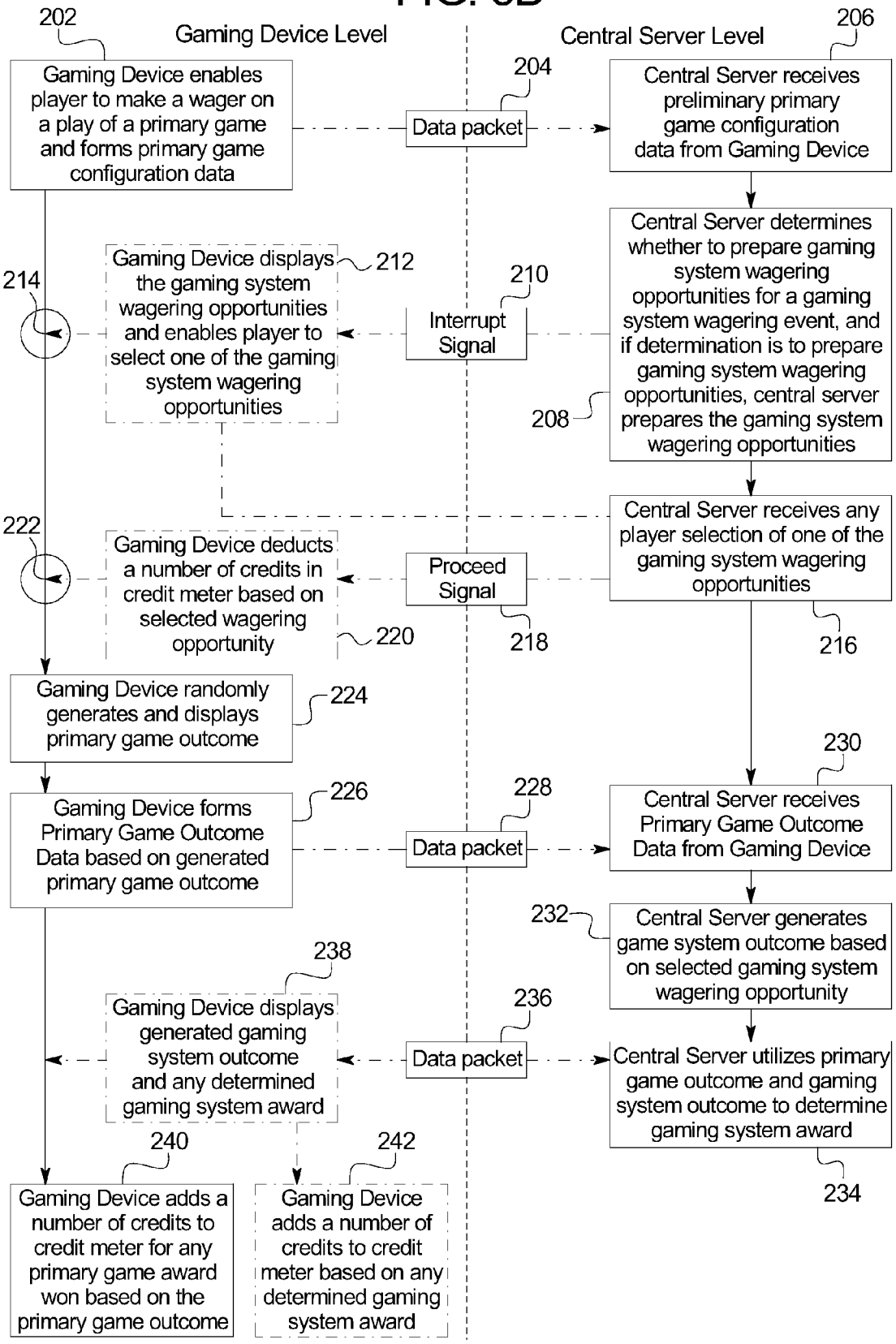
FIG. 3B is a process flow diagram showing one possible flow sequence of one example embodiment of the present disclosure.

Referring now to FIG. 3B, one example embodiment of the server-based gaming system of the present disclosure operates according to sequence 200. In one embodiment, the gaming system disclosed herein includes a central server, central controller or remote host configured to communicate with or link to a plurality of gaming machines or gaming devices. The central server or controller may be any suitable server or computing device which includes at least one processor and a memory or storage device. In alternative embodiments, the central server is a gaming machine in the gaming system. Each of the gaming devices of the gaming system includes at least one primary or base game. It should be appreciated that the gaming devices may include any suitable primary or base game. In different embodiments, the gaming devices of the gaming system may include the same or different types of primary games which may be made by the same or different manufacturers.

In operation, each gaming device of the gaming system enables a player to make a primary game wager on a play of the primary game of that gaming device. The gaming device forms preliminary primary game configuration data based on this, as indicated by block 202. It should be appreciated that the preliminary primary game configuration data include one or more primary game characteristics, such as the type of game, a time the game was initiated, a wagering denomination, a number of active paylines, a wager amount per payline, etc. The gaming device transmits a data packet 204 which includes the preliminary primary game configuration data to the central server. The central server receives the preliminary primary game configuration data, as indicated by block 206. The central server may acknowledge or confirm receipt of the data packet in a reply communication or signal. Similarly, when data is transmitted from the server to the gaming device, the gaming device may send a communication or signal to the central server to confirm receipt of such data.

Upon receiving the preliminary primary game configuration data from the gaming device, the central server determines whether to prepare one or more gaming system wagering opportunities for a gaming system wagering event. If the determination is to prepare the wagering opportunities, the central server prepares the gaming system wagering opportunities for the gaming system wagering event, as indicated by block 208. In one embodiment, each gaming system wagering opportunity of the gaming system wagering event enables the player to obtain a gaming system outcome for making a gaming system wager of a designated amount.

In one embodiment, the central server prepares the gaming system wagering opportunities for the gaming system wagering event if the primary game wager placed by the player meets a designated level or threshold. For example, in one embodiment, a player must place a primary game wager of at least a designated amount, such as twenty credits, for the central server to prepare the gaming system wagering opportunities. In different embodiments, the designated level or threshold is predetermined, randomly determined, determined based on the player's status (such as determined through a player tracking system), determined based on time (such as the time of day), determined based on an amount of coin-in accumulated in one or more pools, determined based on a denomination (e.g., penny, nickel, dime, quarter, etc.), determined based on any other suitable method or criteria, or determined based on a combination of these. In different embodiments, the designated level or threshold may be the same or may be different for different players. In other embodiments, the player's primary game wager does not need to meet a designated level or threshold for the central server to prepare one or more gaming system wagering opportunities for the player.

In different embodiments, the number and/or type of gaming system wagering opportunities which are prepared for a particular player are determined based on the primary game configuration data which is communicated from that player's gaming device to the central server. For example, the number and/or type of gaming system wagering opportunities prepared for the player may be based on the player's primary game wager or any other activity associated with play of the primary game. In different embodiments, the number and/or type of gaming system wagering opportunities prepared for a player are predetermined, randomly determined, determined based on player tracking, determined based on the player's wager level, determined based on time (such as the time of day), determined based on game type, determined based on a number of game components wagered on (e.g., number of paylines, number of hands, etc.), determined based on any other suitable criteria, or determined based on any combination of these.

The central server transmits an interrupt signal 210 to the gaming device which causes the gaming device to display the gaming system wagering opportunities to the player and enable the player to select one of the gaming system wagering opportunities, as indicated by block 212. In this manner, at point 214, the central server interrupts or stops the play of the primary game on the gaming device after the configuration of the bet but before a primary game outcome is generated to display the gaming system wagering opportunities of the gaming system wagering event. It should be appreciated that block 212 is shown in phantom to illustrate that, although the gaming device is displaying the gaming system wagering opportunities of the gaming system wagering event, the central server is causing the gaming device to do this, while the primary game remains under control of the gaming device processor. It should further be appreciated that the central server may cause the wagering opportunities to be displayed to the player after a primary game outcome is generated but before the primary game outcome is displayed to the player or at any other suitable time.

In one embodiment, the gaming system utilizes at least part or all of a display device on the gaming device to display the gaming system wagering event to the player. In one such embodiment, the gaming system utilizes at least part or all of the display device on the gaming device to display: (i) the gaming system wagering opportunities available to the player; (ii) the gaming system wager associated with each of the available gaming system opportunities; (iii) the type of gaming system outcome provided for placing a gaming system wager; (iv) any help screens to describe to the player how selecting a particular one of the wagering opportunities affects play of the game; (v) any gaming system award won by the player; and (vi) any other information related to the gaming system wagering event. In different embodiments, the gaming system utilizes one or more service windows, pop-up windows or non-overlapping windows, such as described in U.S. Published Patent Application No. 2007/0243925, to convey any suitable information regarding the gaming system wagering event to the player. It should be appreciated that the service windows, pop-up windows or non-overlapping windows used to display the gaming system wagering event are under at least partial control of the central server.

In one embodiment, the gaming system wagering event is displayed to the player via a server-controlled service window or interface, which is configured to display the available gaming system wagering opportunities of the gaming system wagering event and to receive player inputs from input devices coupled to the gaming device, such as a touch screen. In such an embodiment, the player utilizes the service window or interface to view the available gaming system wagering opportunities, input selections of the gaming system wagering opportunities, input gaming system wagers associated with the gaming system wagering opportunities, and view the gaming system outcome and any gaming system award(s) won. In another embodiment, the service window is displayed on an external display (i.e., a display which is not controlled by or attached to the gaming device).

Referring back to FIG. 3B, the central server receives any player selection of one of the displayed gaming system wagering opportunities, as indicated by block 216. The central server transmits a proceed signal 218 to the gaming device, which causes the gaming device to deduct a number of credits from the credit meter to cover the gaming system wager associated with any selected gaming system wagering opportunity, as indicated by block 220. In one embodiment, if the player does not have sufficient funds remaining in the credit meter to cover the gaming system wager, the central server causes the gaming device to enable the player to deposit additional funds into the gaming device. In another embodiment, if the player does not have sufficient funds to cover the gaming system wager, the central server disables or inactivates the gaming system wagering event. Once the gaming device updates the credit meter to reflect any gaming system wager placed, at point 222, primary game play resumes. In one embodiment, the central server causes the gaming device to enable the player to choose not to select any of the gaming system wagering opportunities, such as by selecting a "no thanks" option. If the player chooses not to select any of the gaming system wagering opportunities, the central server transmits the proceed signal to the gaming device, which causes game play to resume.

As indicated by block 224, the gaming device randomly generates and displays a primary game outcome for the play of the primary game. The gaming device forms primary game outcome data based on the generated primary game outcome, as indicated by bock 226. It should be appreciated that primary game outcome data includes, as appropriate, winning or losing primary game outcomes and any associated primary game awards for the play of the primary game. The gaming device transmits a data packet 228 which includes the primary game outcome data to the central server. The central server receives the primary game outcome data, as indicated by block 230.

The central server generates a gaming system outcome for the gaming system wagering event based on any selected gaming system wagering opportunity, as indicated by block 232. In one embodiment, the central server generates a gaming system outcome for the gaming system wagering event by determining a gaming system modifier, such as a multiplier, as discussed below. As indicated by block 234, the central server utilizes the gaming system outcome and the primary game outcome to determine a gaming system award. It should be appreciated that the gaming system award may result in an additional award amount, such as a number of credits, provided to the player in addition to any primary game award won by the player for the play of the primary game.

The central server transmits a data packet 236 which includes information regarding the gaming system wagering event (e.g., the gaming system outcome and any determined gaming system award) to the gaming device, which causes the gaming device to display the generated gaming system outcome and any gaming system award to the player, as indicated by block 238. As indicated by block 240, the gaming device adds a number of credits to a credit meter to reflect any primary award won based on the primary game outcome. As indicated by block 242, if additional credits are owed to the player based on the determined gaming system award, the central server causes the gaming device to add a number of credits to the credit meter based on any determined gaming system award.

In this example embodiment, by placing a gaming system wager on the gaming system wagering event, the player obtains the chance to win a gaming system award which is determined remotely by the central server in addition to the player's existing chance of obtaining a primary game award based on a primary game outcome which is determined locally by the gaming device processor.

The gaming system of the present disclosure thus provides a gaming system wagering event configured to be delivered to many different types of gaming devices, which can include game software manufactured by different gaming device manufacturers, without having specific game software associated with each gaming device and/or without having to change or modify the game programs or paytables associated with such gaming devices. In certain embodiments, the gaming system disclosed herein enables gaming establishments to offer gaming system wagering events that are branded to the gaming establishment and thus build player loyalty to the gaming establishment.

Referring now generally to FIGS. 4A, 4B, 4C, 4D, 4E, and 4F one example embodiment of the mathematical structure for determining the gaming system outcome for the gaming system wagering event is generally illustrated. More specifically, FIGS. 4A, 4B, 4C, 4D, 4E, and 4F describe how a gaming system multiplier is generated for an example gaming system wagering event, such as the example gaming system wagering event described in relation to FIGS. 5A to 5J.

Referring now to FIGS. 5A, 5B, 5C, 5D, 5E, 5F, 5G, 5H, 5I, and 5J, one example embodiment of the gaming system of the present disclosure provides a gaming system wagering event or offer which enables a player to obtain a gaming system multiplier for making a gaming system wager. In the illustrated example embodiment, the central server provides the gaming system wagering event or offer to a player playing at a gaming device of the gaming system if the player's total wager on a play of the primary game meets or exceeds a designated wager amount, such as twenty credits. Thus, if the player is betting less than twenty credits on the play of the primary game, the central server does not provide the gaming system wagering event (i.e., the player does not have the opportunity to obtain a gaming system multiplier). If the player wagers twenty credits or more on the play of the primary game, then the central server provides the gaming system wagering event or offer. Gaming establishments can easily set the criteria for determining when to provide the gaming system wagering event or offer to a particular player. This facilitates direct control over when a player is offered the opportunity to increase the average expected payback per credit wagered.

Figure 5A:
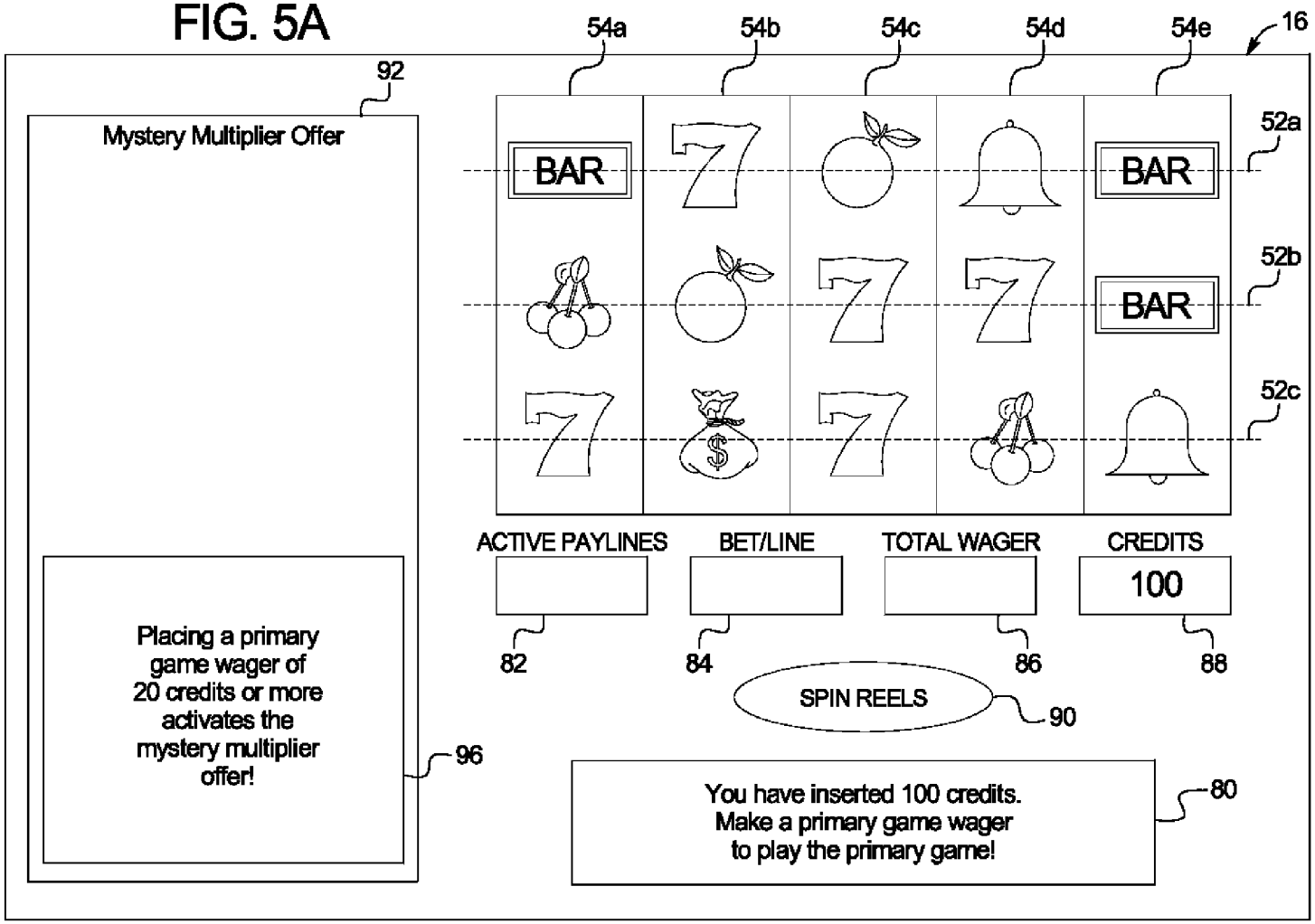
FIGS. 5A, 5B, 5C, 5D, 5E, 5F, 5G, 5H, 5I, and 5J illustrate screen shots of one example embodiment of the gaming system of the present disclosure.

As seen in FIG. 5A, the gaming device of this example embodiment includes a display device 16 having five reels 54*a*, 54*b*, 54*c*, 54*d*. and 54*e* that are associated with twenty paylines (not fully shown). Three of the paylines 52*a*, 52*b*, and 52*c* are shown in phantom for illustration purposes. The display device 16 further includes an active paylines meter 82, a bet per line meter 84, a total wager meter 86, a credit meter 88, and a "spin reels" button 90. The display device 16 further includes a message display 80 for providing information regarding game play.

A gaming system service window 92 controlled by the central server is displayed on the display device 16. The gaming system service window 92 is configured to display the gaming system wagering event. The gaming system service window 92 includes a gaming system message display 96 for providing instructions and information regarding the gaming system wagering event to the player. In the illustrated embodiment, if the gaming system wagering event is activated, the gaming system wagering event provides an opportunity for the player to place a gaming system wager to obtain a multiplier.

In the illustrated embodiment, the gaming system service window 92 is displayed on the display device. In this embodiment, the gaming system service window service 92 remains displayed on the display device at all times during game play. The gaming system service window 92 indicates to the player whether it is in an "active" state or an "inactive" state based on whether or not the player has placed the requisite primary game wager to activate the gaming system wagering event. In the illustrated embodiment, the service window is displayed on a portion of the gaming device, adjacent to the primary game. In various embodiments, the gaming system service window may be displayed in any suitable manner, such as adjacent to the primary game on the gaming device display device, fully or partially covering the primary game on the gaming device display device, or on an external display device which is not attached to or controlled by the gaming device. In an alternative embodiment, the gaming system service window is only displayed to the player when the gaming system wagering event is activated. In one such embodiment, the gaming system service window appears and re-appears on an "as needed" basis to display information and receive player inputs relating to the gaming system wagering event.

Upon sitting down at the gaming device, a player inserts funds into the gaming device. In FIG. 5A, the credit meter 88 shows the number one hundred, indicating that the player has deposited an amount of funds equivalent to one hundred credits into the gaming device. The active paylines meter 82, bet per line meter 84, and total wager meter 86 are currently black, indicating that the player has not yet placed a wager on a play of the primary game. The gaming device prompts the player to make a primary game wager to play the game, as indicated by message display 80. As indicated by the gaming system message display 96 of the gaming system service window 92, the central server informs the player that placing a primary wager of twenty credits or more activates the gaming system wagering event (i.e., the "Mystery Multiplier Offer").

Figure 5B:
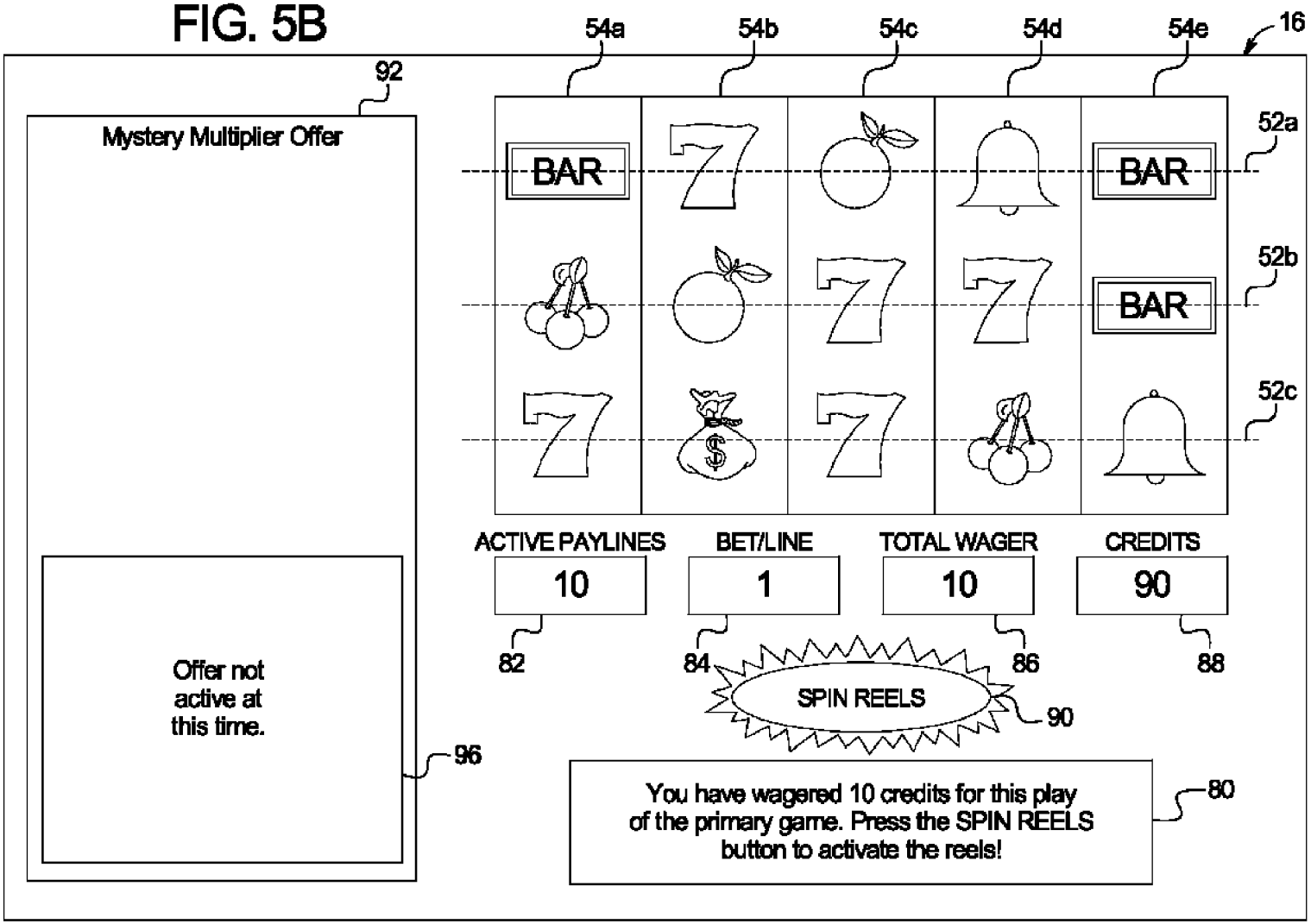

As seen in FIG. 5B, the player activates ten of the paylines, as indicated by the active paylines meter 82, by wagering one credit on each of the ten paylines, as indicated by the bet per line meter 84. Accordingly, the player places a total primary game wager of ten credits on the first play of the primary game, as indicated by the total wager display 86. The credit meter 88 is updated to reflect the primary game wager placed by the player and, therefore, shows the number ninety. It should be appreciated that, after the player places the primary game wager, the gaming device communicates data regarding the primary game wager placed to the central server. As discussed above, in this example embodiment, the total amount wagered on the primary game must be equal to or greater than twenty credits for the central server to provide the gaming system wagering event. Since the player's primary game wager (i.e., 10 credits) is not equal to or greater than twenty credits, the central server determines not to provide the gaming system wagering event. Accordingly, the gaming system message display 96 of the gaming system service window 92 displays a message informing the player that the gaming system wagering event is not active at this time.

The gaming device prompts the player to press the spin reels button 90, as indicated by message display 80. The spin reels button 90 is highlighted to indicate that the player may press the spin reels button 90 at this time.

Figure 5C:
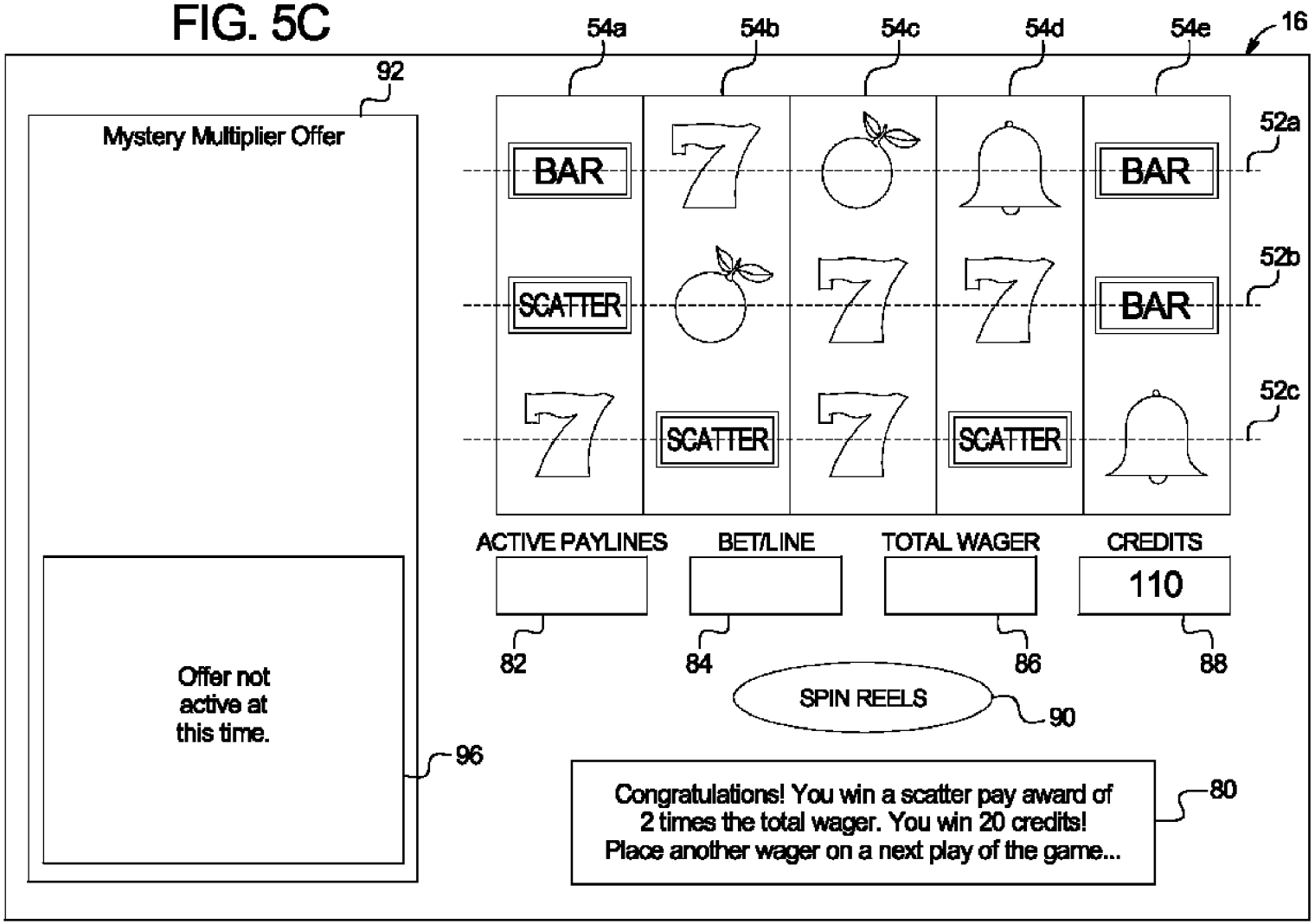

As seen in FIG. 5C, as a result of the reel spin, three "SCATTER" symbols are indicated on the reels. Three SCATTER symbols generated anywhere on the reels results in a scatter pay award. As indicated by the message in the message display 80, the player wins a scatter pay award of two times the total primary game wager placed. Thus, the player wins a primary game award of twenty credits (i.e., primary game wager of ten credits, times two). The credit meter 88 is updated to reflect that the player has won a primary game award of twenty credits based on the primary game outcome. The credit meter 86 now shows the number one hundred ten. The gaming device prompts the player to make another primary game wager to play the game again, as indicated by the message display 80.

Figure 5D:
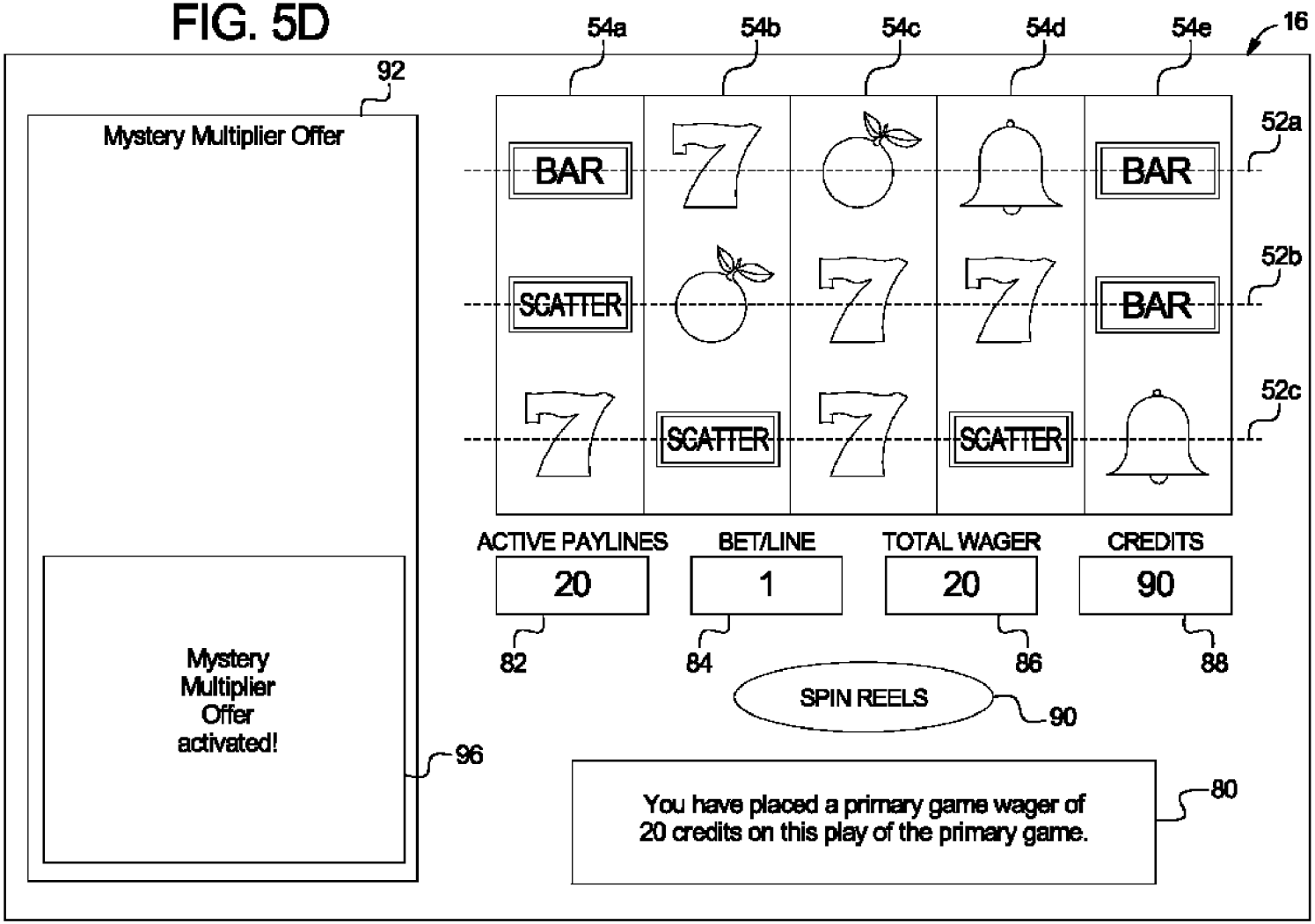

In FIG. 5D, the player activates all twenty of the paylines, as indicated by the active paylines meter 82, by wagering one credit on each of the twenty paylines, as indicated by the bet per line meter 84. Accordingly, the player places a total primary game wager of twenty credits on the second play of the primary game, as indicated by the total wager display 86. The credit meter 88 is updated to reflect the primary game wager placed by the player and shows the number ninety.

Since the players primary game wager of twenty credits meets the designated wager amount, the central server determines to provide the gaming system wagering event. The gaming system message display 96 of the gaming system service window 92 displays a message informing the player that the gaming system wagering event is activated. The central server will interrupt the play of the primary game to provide the gaming system wagering event. Accordingly, in FIG. 5D, the spin reels button is not highlighted and thus cannot be activated at this time.

Figure 5E:
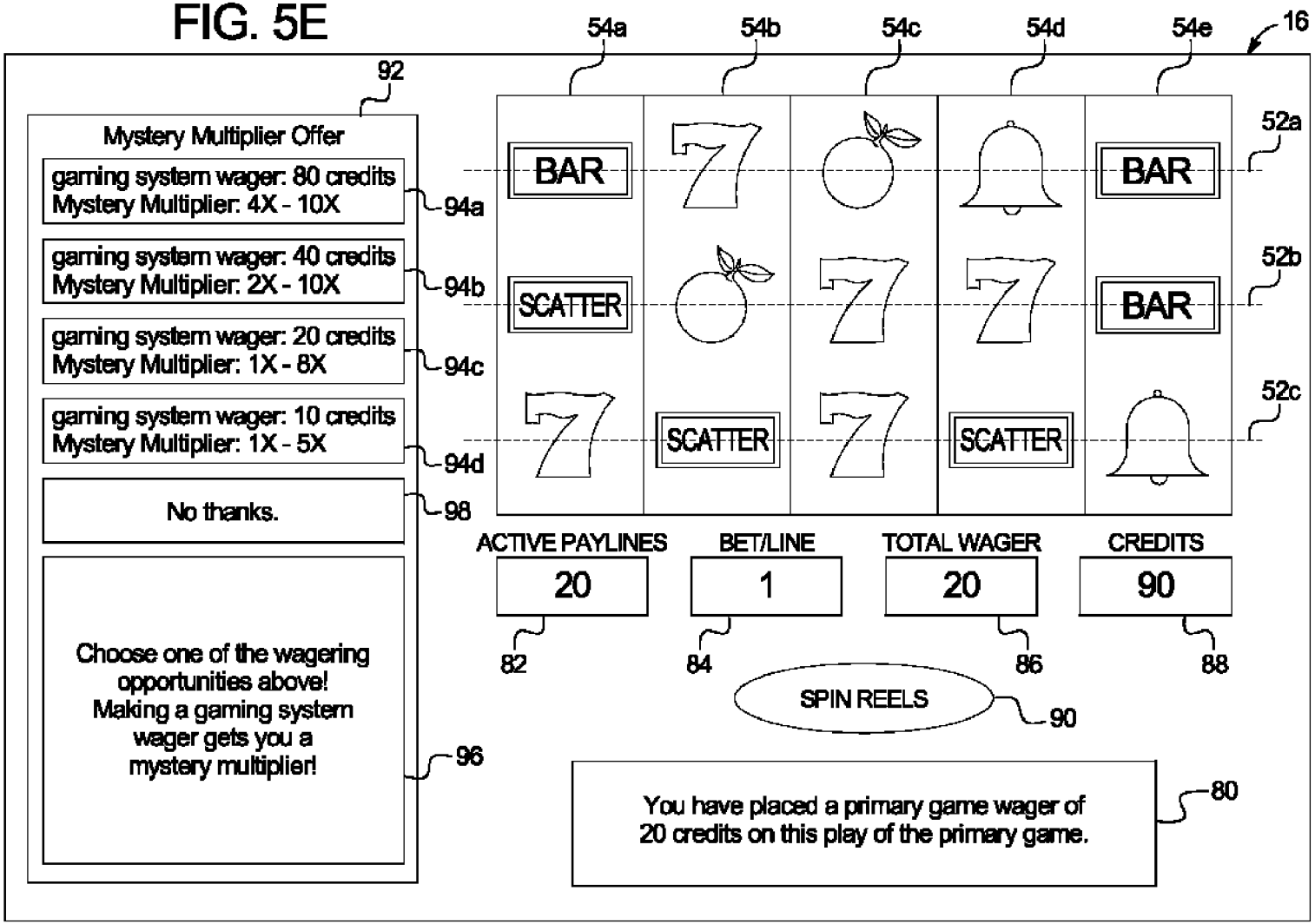

In FIG. 5E, the gaming system service window 92 displays a plurality of wagering opportunities 94*a*, 94*b*, 94*c*, and 94*d* of the gaming system wagering event. The gaming system wagering-opportunities 94*a*, 94*b*, 94*c*, and 94*d* are each associated with a different gaming system wager (i.e., 10, 20, 40, and 80 credits, respectively) and a different range of multipliers. For example, the fourth gaming system wagering opportunity 94*d* is associated with a gaming system wager of ten credits and a 1× to 5× range of multipliers. The third gaming system wagering opportunity 94*c* is associated with a gaming system wager of twenty credits and a 1× to 8× range of multipliers. The gaming system service window 92 also includes a "NO THANKS" option 98. If the player selects the NO THANKS option 98, the player chooses to make no gaming system wager on the gaming system wagering event and thus will not obtain a gaming stem multiplier.

As discussed above, in the illustrated embodiment, the gaming system service window 92 is displayed adjacent to the primary game. However, it should be appreciated that, in other embodiments, the gaming system service window pops up onto the display device after the gaming system wagering event is activated and covers a portion of the primary game, so as to provide another visual indication that game play is temporarily interrupted.

It should be also appreciated that the amount of time it takes for: (1) the gaming device to transmit primary game configuration data (which includes the primary game wager placed) to the central server; (2) the central server to evaluate the primary game wager to determine whether to provide the gaming system wagering event; (3) the central server to prepare the gaming system wagering opportunities for the gaming system wagering event; and (4) the central server to cause the gaming device to display the gaming system wagering event via the service window, is just fractions of a second. That is, all of the communications between the gaming device and the central service happen very quickly, so as not to dramatically slow down game play.

In FIG. 5E, the gaming system message display 96 of the gaming system service window 92 prompts the player to select one of the gaming system wagering opportunities and explains that, if the player selects one of the gaming system wagering opportunities 94*a*, 94*b*, 94*c*, and 94*d*, the central server will randomly generate a gaming system multiplier from the range of multipliers associated with the selected gaming system wagering opportunity. The central server utilizes at least the randomly generated gaming system multiplier and the primary game outcome to determine a gaming system award. In an example embodiment, the central server modifies any primary game award associated with the primary game outcome by the randomly generated gaming system multiplier. If the product of the primary game award and the gaming system multiplier is higher than the primary game award, the difference between this product and the primary game award amount is the gaming system award, as discussed below.

In certain embodiments, the gaming system service window may include one or more help or information buttons to assist a player in deciding which of the gaming system wagering opportunities to choose. In one such embodiment, activating the help or information buttons causes a display of a help/information window or screen which provides further information regarding the different available gaming system wagering opportunities. In one such embodiment, the help/information window or screen includes text information about the gaming system wagering opportunities. In other embodiments, the help/information window or screen launches a sample play of the game when a particular gaming system wagering opportunity is selected.

Figure 5F:
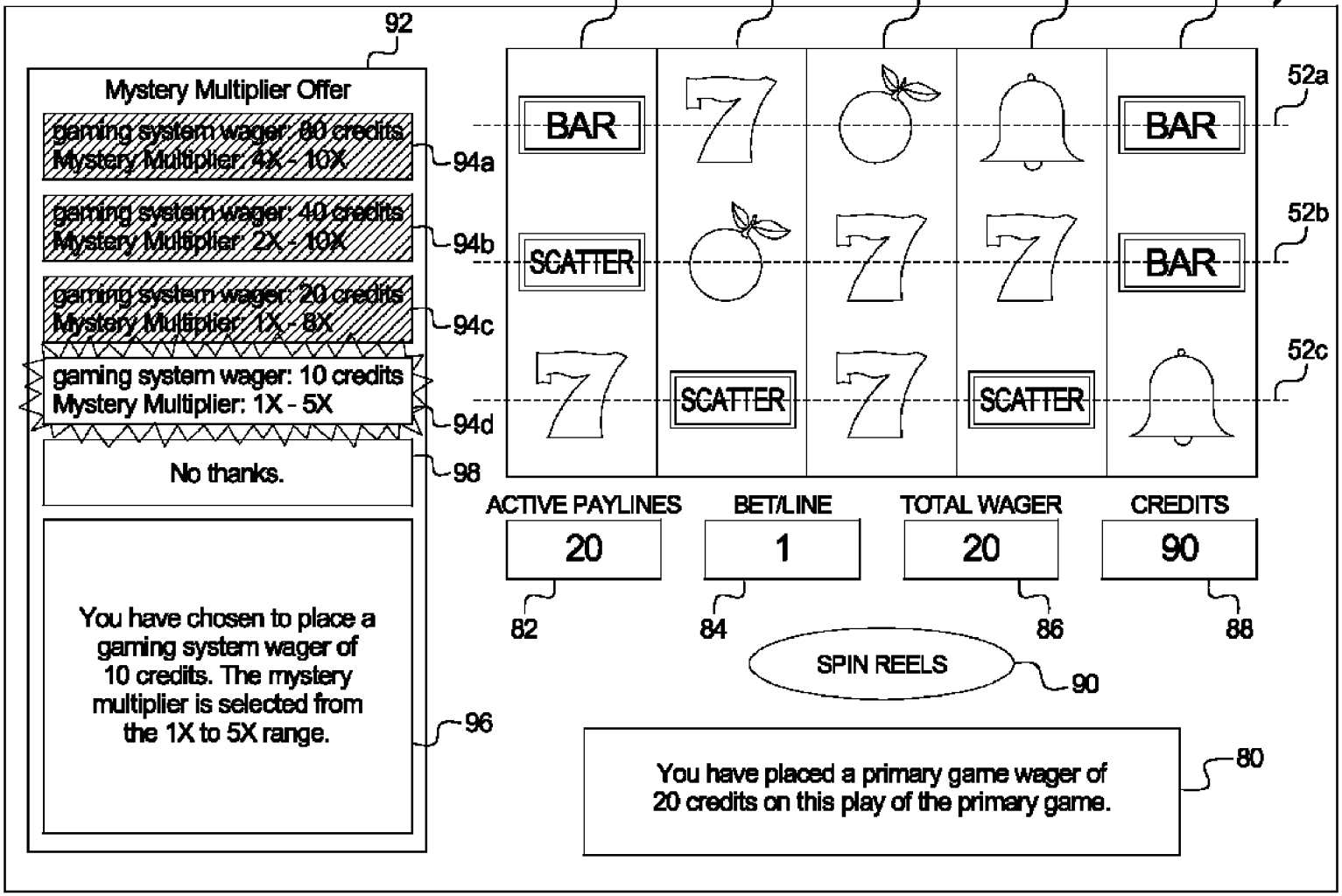

As seen in FIG. 5F, the player has selected the fourth gaming system wagering opportunity 94*d*, which is highlighted to indicate this. The other wagering opportunities 94*a*, 94*b*, and 94*c* are shaded to indicate that the player has not selected these gaming system wagering opportunities. The gaming system wagering opportunity 94*d* is associated with a gaming system wager of ten credits and a multiplier range of 1× to 5×.

Figure 5G:
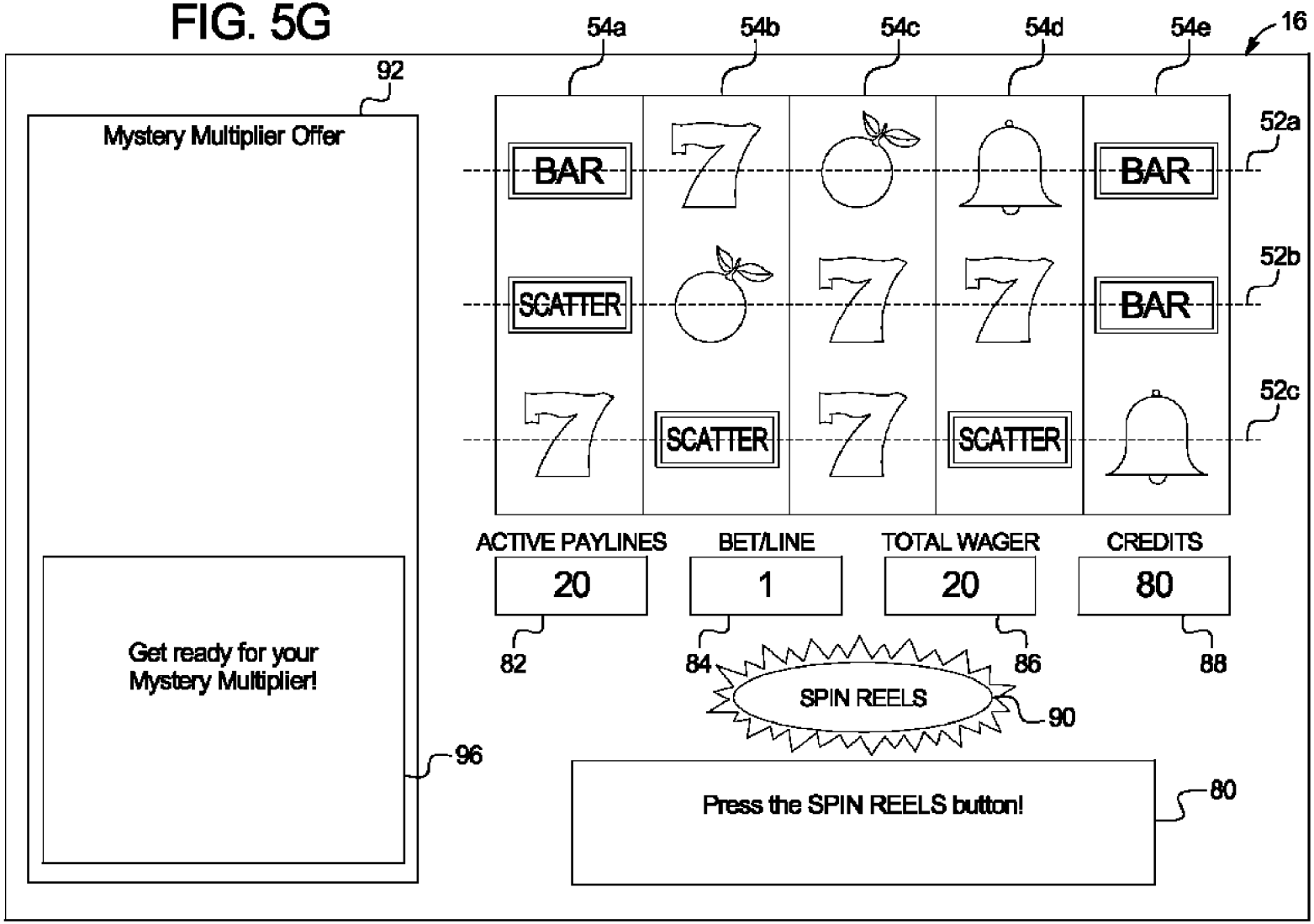

It should be appreciated that, when the player chooses to place a gaming system wager on the gaming system wagering event (by selecting one of the gaming system wagering opportunities), the gaming system wager is on the server-controlled gaming system wagering event and is not initially recognized by the gaming device. At this point, the gaming device only recognizes the primary game wager. Thus, as illustrated in FIG. 5G, after the player places the gaming system wager on the gaming system wagering event, the central server communicates this to the gaming device and instructs the gaming device to update the credit meter. Accordingly, the credit meter 88 now shows the number eighty.

As also seen in FIG. 5G, the spin reels button 90 is highlighted, indicating that the player can now utilize the spin reels button 90 to cause the reels to spin. In one embodiment, when the player inputs a selection of one of the gaming system wagering opportunities displayed by the gaming system service window 92, this automatically causes the reels of the primary game to spin. In another embodiment, the gaming system service window 92 includes a "spin reels" button that the player can utilize to activate the reels of the primary game. In certain embodiments, a player can set a certain gaming system wager that will be made automatically for a designated number of plays, such as each play, of the primary game through player preferences. That is, the player can repeat the same gaming system wager for those designated number of plays of the game.

Figure 5H:
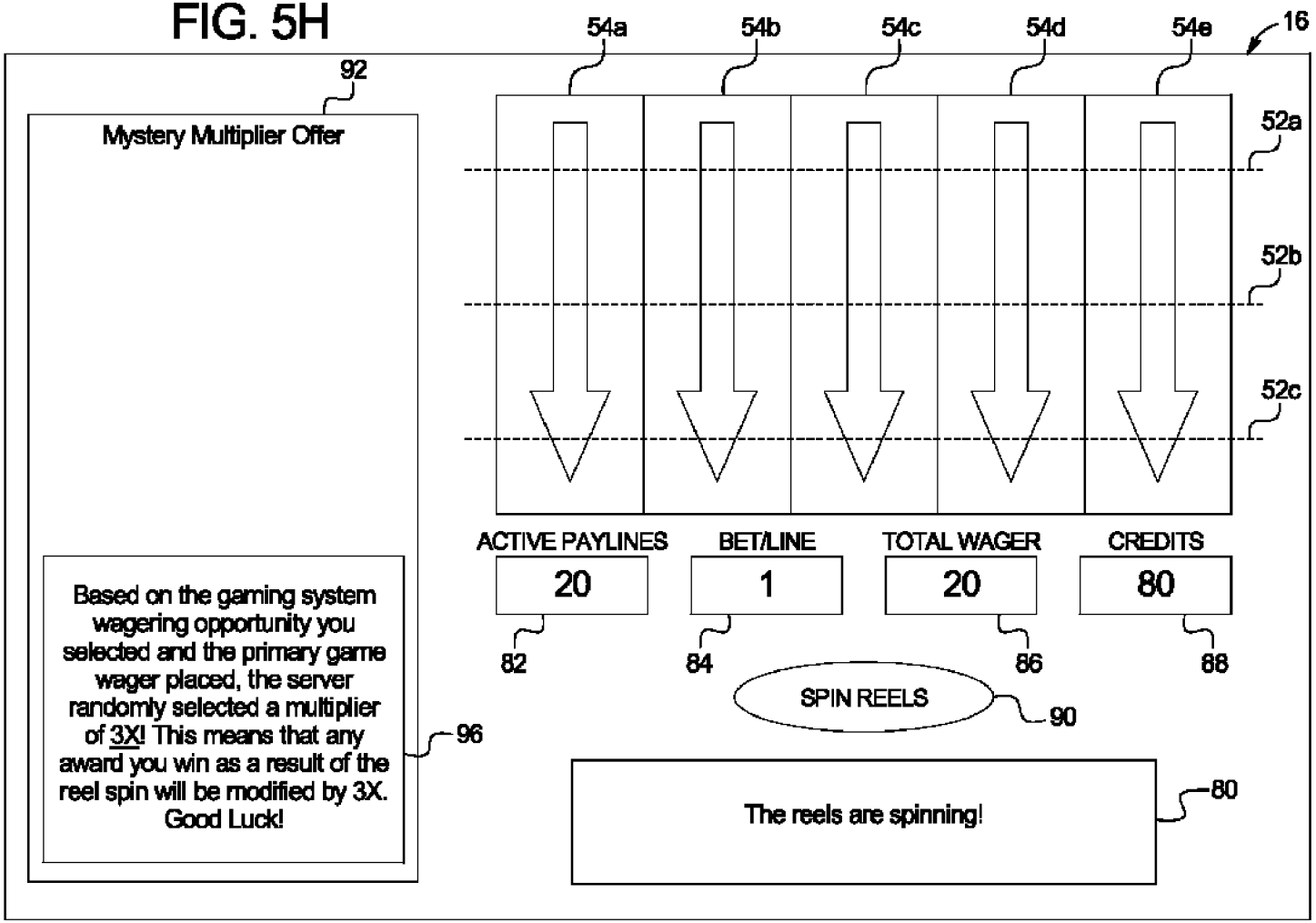
Figure 5:
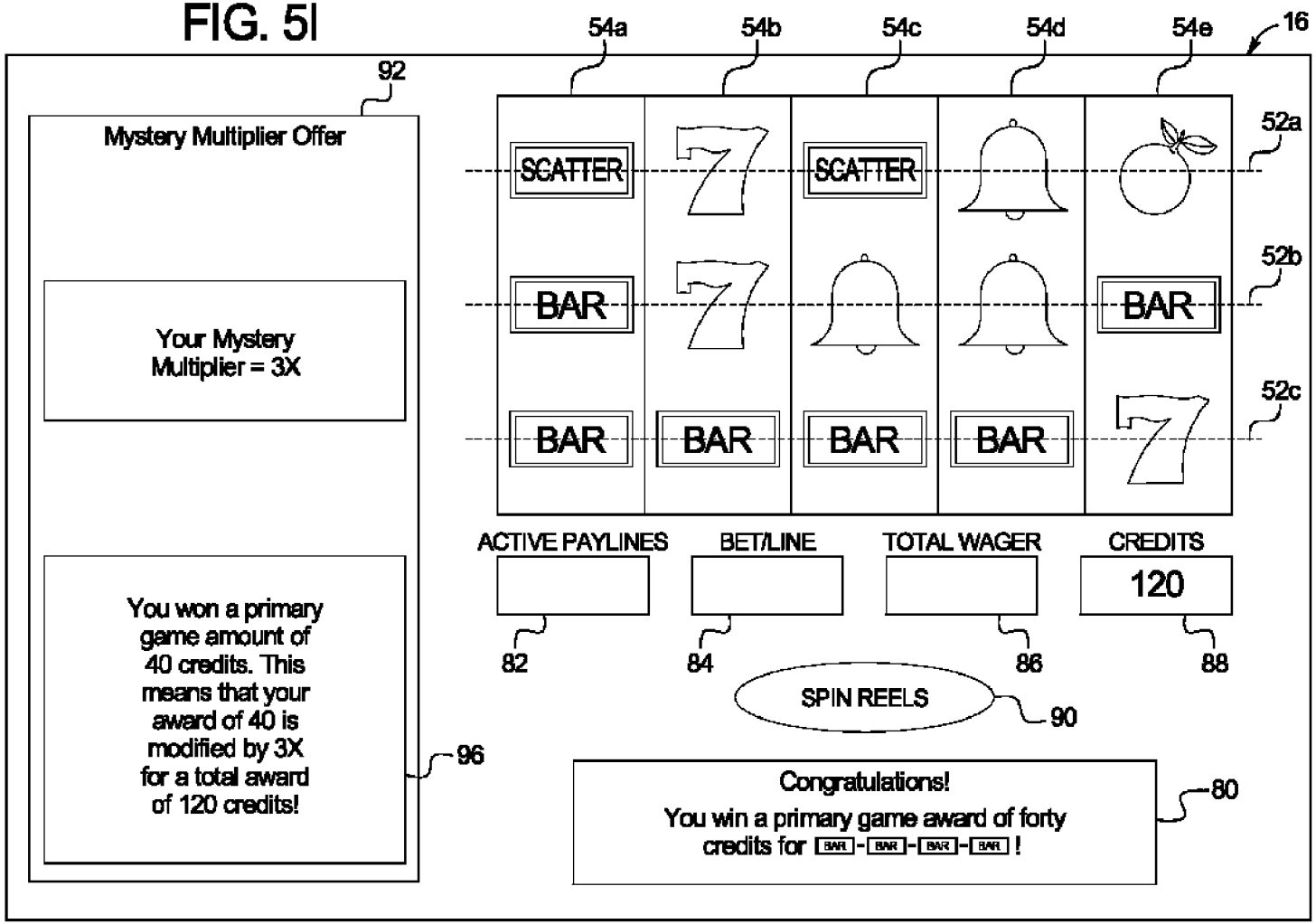

As illustrated in FIG. 5H, the reels 54*a*, 54*b*, 54*c*, 54*d*, and 54*e* are spinning. In the illustrated embodiment, while the reels are spinning, the central server randomly generates or selects a gaming system multiplier from the range of multipliers associated with the selected gaming system wagering opportunity. In different embodiments, the central server selects a gaming system multiplier from the range of multipliers associated with the selected gaming system wagering opportunity based on one or more of: (i) the player's primary game wager; (ii) the player's status (such as determined through a player tracking system); (iii) a generated symbol or symbol combination; (iv) a random determination; (v) time (such as the time of day); (vi) an amount of coin-in accumulated in one or more pools; or (vi) any other suitable criteria. In the illustrated embodiment, the central server randomly generates the gaming system multiplier while the reels are spinning and before a primary game outcome is displayed to the player. In various different embodiments, the central server generates the gaming system multiplier: (i) before a primary game outcome is generated; (ii) after the primary game outcome is generated but before it is displayed to the player; (iii) after the primary game outcome is displayed to the player; or (iv) at any other suitable time.

Referring now to FIG. 4A, the illustrated table 300*a* lists the example gaming system wagering opportunities available to a player in the gaming system wagering event as a result of the player making a primary game wager of twenty credits. It should be appreciated that these gaming system wagering opportunities are the same as the gaming system wagering opportunities 94*a*, 94*b*, 94*c*, and 94*d* offered to the player in the gaming system wagering event in the example of FIGS. 5A to 5J. For example, a first gaming system wagering opportunity 94*d* is associated with a gaming system wager of ten credits and a 1× to 5× range of multipliers. A second gaming system wagering opportunity 94*c* is associated with a gaming system wager of twenty credits and a 1× to 8× range of multipliers. As indicated by the table 300*a*, each of the gaming system wagering opportunities 94*a*, 94*b*, 94*c*, and 94*d* is associated with a gaming system wager that has a designated relationship to the primary game wager placed by the player. For example, the gaming system wager for gaming system wagering opportunity 94*d* is half of the primary game wager ("the ½× gaming system wagering opportunity"), and the gaming system wager for gaming system wagering opportunity 94*a* is four times the primary game wager ("the 4× gaming system wagering opportunity").

In one embodiment, the central server selects a gaming system multiplier from the range of multipliers associated with the selected gaming system wagering opportunity based on the player's primary game wager. In one such embodiment, for each of the gaming system wagering opportunities, the server stores a plurality of different multiplier tables. Each of the different multiplier tables associated with that particular one of the gaming system wagering opportunities corresponds to a different primary wager amount. The central server chooses which of these multiplier tables to employ for selecting the gaming system multiplier based on the primary game wager placed by the player.

Referring now to FIGS. 4B and 4C, the following describes an example where a player has chosen the ½× gaming system wagering opportunity for the gaming system wagering event. That is, the player elects to place a gaming system wager on the gaming system wagering event that is equal to half of the primary game wager amount. The table 300*b* of FIG. 4B shows the different multiplier tables associated with the ½× gaming system wagering opportunity which may be employed to select the gaming system multiplier. The central server chooses which of these multiplier tables to employ for selecting the gaming system multiplier based on the primary game wager depending on the primary wager placed by the player. For example, as indicated in table 300*b*, if the player places a primary game wager of twenty credits, the central server utilizes multiplier table A to determine the gaming system multiplier. The average multiplier for multiplier table A is 1.625×. By obtaining a multiplier of 1.625×, this causes the average expected payback associated with the play of the game to increase from 85% to 92.1%, as indicated by the table 300*b*.

In FIG. 4C, the table 300*c* shows an example multiplier table, and specifically the multiplier table A referred to above. The illustrated example multiplier table includes each of the multipliers of the range of multipliers associated with the ½× gaming system wagering opportunity. That is, multiplier table includes multipliers in the 1× to 5× range. Each of the multipliers is associated with a likelihood or probability of being selected by the central server. For example, the 1× multiplier has a 60% chance of being selected. The 5× multiplier has a 2.5% chance of being selected. Based on the this distribution or weighting of the multipliers in the multiplier table, the average multiplier selected when the central server employs this multiplier table is 1.625×.

Referring back to FIG. 4B, if, instead of placing a primary game wager of twenty credits, the player places a primary game wager of two hundred credits, the central server uses multiplier table E to determine the gaming system multiplier. In FIG. 4D an example multiplier table E 300*d* is shown. Multiplier table E 300*d* includes each of the multipliers of the range of multipliers associated with the ½× gaming system wagering opportunity. That is, multiplier table includes multipliers in the 1× to 5× range. Each of the multipliers is associated with a likelihood or probability of being selected by the central server. For example, the 1× multiplier has a 55% chance of being selected. The 5× multiplier has a 2.5% chance of being selected. Based on the this distribution or weighting of the multipliers in the multiplier table, the average multiplier selected when the central server employs this multiplier table is 1.725×.

It should thus be appreciated that, in this example embodiment, placing a higher primary game wager means that the player will have to place a higher gaming system wager on the gaming system event. This, in turn, causes the central server to employ a multiplier table which provides, on average, a higher gaming system multiplier. Obtaining a higher gaming system multiplier causes a greater increase in the average expected payback associated with the play of the game. As discussed above in relation to FIG. 4B, obtaining a multiplier of 1.625× causes the average expected payback associated with the play of the game to increase from 85% to 92.1%. However, obtaining a multiplier of 1.725× causes the average expected payback associated with the play of the game to increase from 85% to 97.8%.

It should be appreciated that FIG. 4B only shows the multiplier tables for the ½× gaming system wagering opportunity (i.e., multiplier tables A, B, C, D, and E) and the average multipliers associated with those multiplier tables. The central server stores a different group of multiplier tables for each of the different gaming system wagering opportunities. For example, for the 4× wagering opportunity, the central server stores multiplier tables F, G, H, I, and J which correspond to primary game wagers of twenty credits, forty credits, sixty credits, one hundred credits, and two hundred credits, respectively.

In various embodiments, a particular multiplier table may differ from another multiplier table because of: (i) the average multiplier provided by that table; (ii) the volatility of that multiplier table; (iii) the weighting or distribution of the multipliers in that multiplier table; (iv) the number of different multipliers in that multiplier table; (v) any other suitable characteristic of that multiplier table; and (vi) any combination of these.

Referring now to FIG. 4E, table 300*e* shows, for each of the different gaming system wagering opportunities 94*a*, 94*b*, 94*c*, and 96*d* of FIG. 4A, the average multiplier determined by the central server if a player has made a primary game wager of twenty credits. For example, if the player chooses the ½× gaming system wagering opportunity (which would require the player to place a gaming system wager of ten credits), the average multiplier determined by the central server is 1.625×. This causes the average expected payback associated with the play of the game to increase from 85% to 92.1%. If the player chooses the 4× gaming system wagering opportunity (which would require the player to place a gaming system wager of eighty credits), the average multiplier determined by the central server is 5.6×. This causes the average expected payback associated with the play of the game to increase from 85% to 95.2%.

FIG. 4F illustrates how placing a larger primary wager causes the average multiplier determined by the central server to increase. More specifically, the table 300*f* of FIG. 4F shows, for each of the different gaming system wagering opportunities 94*a*, 94*b*, 94*c*, and 96*d*, the average multiplier determined by the central server if a player has made a primary game wager of two hundred credits. For example, if the player makes a primary game wager of two hundred credits and then chooses the ½× gaming system wagering opportunity (which would require the player to place a gaming system wager of one hundred credits), the average multiplier determined by the central server is 1.725×. This causes the average expected payback associated with the play of the game to increase from 85% to 97.8%. If the player makes a primary game wager of two hundred credits and then chooses the 4× gaming system wagering opportunity (which would require the player to place a gaming system wager of eight hundred credits), the average multiplier determined by the central server is 5.825×. This causes the average expected payback associated with the play of the game to increase from 85% to 99.0%.

It should thus be appreciated that, by placing a higher primary game wager, the player has to make a higher gaming system wager on the gaming system wagering event. However, this gets the players the chance to obtain a higher multiplier in the gaming system wagering event, which in turn results in a greater increase in the average expected payback associated with the play of the primary game.

Referring back to FIG. 5H, the gaming system message display 96 of the gaming system service window 92 displays a message to the player. This message indicates that, based on the player's selection of the fourth wagering opportunity 94*d* and the player's primary game wager of twenty credits, the central server generated a gaming system multiplier of 3×. The message further explains that, if the player wins any primary game award based on the outcome of the reel spin, that primary game award will be modified by the 3× gaming system multiplier. Thus, the player has the chance to win a gaming system award in addition to any primary game award.

As seen in FIG. 5I, as a result of the reel spin, a symbol combination including four "BAR" symbols is indicated on one of the paylines 52*c*. This symbol combination results in an award of forty credits, as indicated by the message in the message display 80. The credit meter 88 is updated to reflect that the player has won a primary game award of forty credits based on the primary game outcome. The credit meter 86 now shows the number one hundred twenty.

In the gaming system service window 92, the gaming system message display 96 displays a message to the player. The message explains that, since the player won an award of forty credits in the primary game, the central server modifies the primary game award of forty credits by the 3× gaming system multiplier. Thus, the total award the player wins in association with this play of the primary game is one hundred and twenty credits (i.e., 40 credits times 3). However, as indicated by the credit meter 88, at this point, the gaming device only recognizes the forty credits that the player won as a result of the primary game outcome. The server must communicate the extra winnings that the player earned in the gaming system wagering event (i.e., the gaming system award of eighty credits) to the gaming device. After receiving information regarding the gaming system award from the central server, the gaming device updates the credit meter 88 to include the gaming system award of eighty credits that the player won by making the gaming system wager on the gaming system wagering event.

Figure 5J:
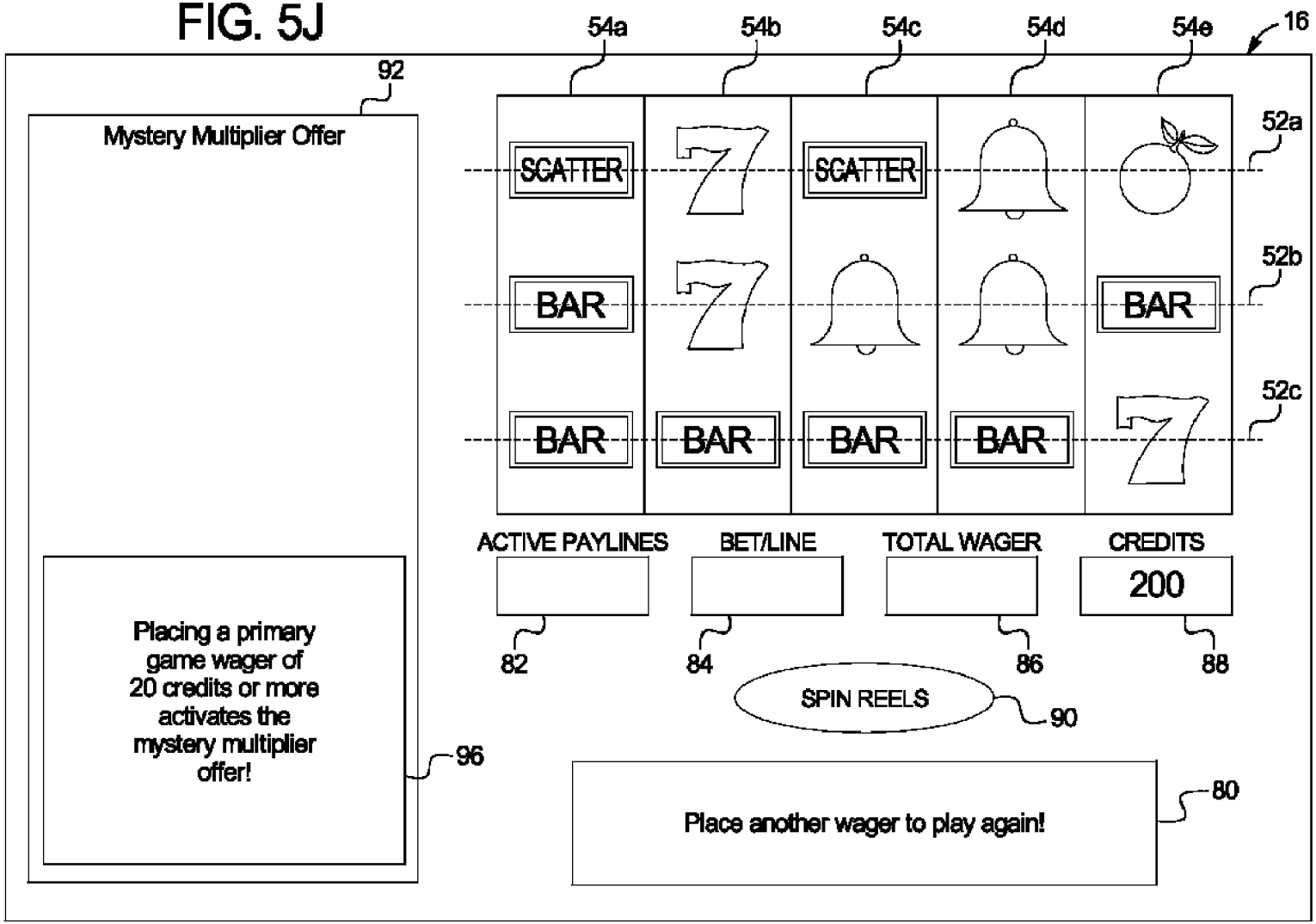

Accordingly, as seen in FIG. 5J, the credit meter 88 has been updated and now shows the number two hundred. The gaming device prompts the player to make another primary game wager to play the game again, as indicated by the message display 80. The gaming system message display 96 of the gaming system service window 92 displays a message informing the player that placing a primary game wager of twenty credits of more activates the gaming system wagering event.

As demonstrated by the example of FIGS. 5A to 5J, a player obtains the chance to win a gaming system award in addition to a primary game award for making a gaming system wager on the gaming system wagering event. More specifically, in the illustrated example embodiment, the player obtained a 3× gaming system multiplier which was applied to the primary game award of forty credits. It should be appreciated that, if the player had hot won a primary game award as a result of the reel spin, the gaming system multiplier of 3× would have modified a primary game award of zero. Thus, that gaming system multiplier would not have resulted in a gaming system award for the player. It should also be appreciated that, if the central server randomly generates a gaming system multiplier of 1×, even if the player obtains a primary game award, modifying the primary game award by a 1× gaming system multiplier does not result in any gaming system award for the player.

The gaming system Wagering event of the present disclosure thus enhances primary game play by providing a player with a chance to win a gaming system award in association with the play of the primary game. The gaming system wagering event enables raising the average expected payback associated with a play of the primary game for making a gaming system wager on the gaming system wagering event, without modifying the average expected payback of the gaming device. The present disclosure thus provides a way to provide players with higher returns for making higher wagers.

The gaming system wagering event disclosed herein also offers more volatility in awards. For example, by enabling the player to split the total wager placed in association with the play of the game, such that the player is betting twenty credits on a primary game and ten credits on the gaming system wagering event (rather than just betting thirty credits on the primary game), this provides a more volatile distribution of awards.

It should be appreciated that awards provided for any secondary or bonus games of a gaming device are calculated into or taken into account in the average expected payback of a gaming device. That is, the average expected payback of the gaming device return is the average expected payback of the primary game plays plus the average expected payback of the bonus game plays. The gaming system wagering event of the present disclosure is configured to sit on top of any primary games and any bonus games of a gaming device as a game overlay, without modifying the game software or code.

Referring now to FIG. 6, the illustrated table 300*g* shows how placing a gaming system wager on the gaming system wagering event affects the average expected payback per credit wagered in one example embodiment of the present disclosure. As indicated in the table 300*e*, if the player does not place a gaming system wager on the gaming system wagering event (either because the player chooses not to select a gaming system wagering opportunity that is offered to the player, or because the player does not place a primary game wager that qualifies for the gaming system wagering event), the average expected payback for the primary game is 85%. Regardless of whether the player places a primary game wager of twenty credits, forty credits, sixty credits, one hundred credits, or two hundred credits, the average expected payback for the primary game is the same—85%.

If the player places a primary game wager of twenty credits and chooses to place a gaming system wager of ten credits on the gaming system wagering event, the central server generates a gaming system multiplier, which modifies any primary game award won based on the primary game outcome. This elevates the average expected payback associated with the play of the game. More specifically, the average expected payback associated with the play of the game changes from 85% to 85.5%. If, instead, the player places a primary game wager of two hundred credits on the primary game and a gaming system wager that is equal to half of the primary game wager amount (i.e., one hundred credits) on the gaming system wagering event, the average expected payback associated with the play of the game increases even more. As seen in FIG. 6, the average expected payback associated with the play of the game changes from 85% to 89%.

The example of FIG. 6 demonstrates how, in certain embodiments, the gaming system wagering event of the present disclosure enables a player to cause the average expected payback associated with the play of the game to increase in two ways or dimensions. That is, the player can cause an increase in the average expected payback associated with the play of the game by placing a larger primary game wager or by placing a larger gaming system wager. If the player increases both the primary game wager and the gaming system wager, such as by wagering the max bet on the primary game and choosing the highest gaming system wagering opportunity, the average expected payback increases even more dramatically. For example, as illustrated in the table 300*g* of FIG. 6, if the player places a primary game wager of two hundred credits and a gaming system wager that is four times primary game wager amount (i.e., eight hundred credits) on the gaming system wagering event, the average expected payback associated with the play of the game increases from 85% to 97%.

It should be appreciated that since the gaming system wagering event is controlled by the central server and occurs independently of the primary game which is controlled by the gaming device processor, the gaming system wagering event enables adjusting the average expected payback associated with a play of the primary game without modifying or changing the primary game or gaming device. Thus, the gaming system wagering event of the present disclosure can be selectively offered to players and can be delivered to many different types of gaming devices without having specific game software or code associated with each gaming device.

In the above example embodiments, the gaming system wagering event provides one or more gaming system wagering opportunities for obtaining a gaming system multiplier. However, it should be appreciated that, in other embodiments, the gaming system wagering event could provide any suitable gaming system wagering opportunities based on the information of the underlying primary game. In certain embodiments, the gaming system wagering opportunities are unrelated to the primary game outcome. For example, the gaming system wagering event may provide a player with one or more opportunities to obtain a gaming system award of a designated number of credits in addition to the player's existing chance of winning an award in the primary game. In one such embodiment, the gaming system award is provided to the player in addition to any primary game award won by the player, but the amount of the gaming system award is determined without regard to the primary game award. In some embodiments, the wagering opportunities could be related to more than one play of the primary game. In one such embodiment, the resolution of the gaming system wagering event may take more than one play of the primary game to determine.

In one embodiment, in the gaming system wagering event, the central server provides a player with one or more gaming system wagering opportunities, which enable the player to place a replay or modifier wager in addition to the primary game wager. The replay or modifier wager applies for a group or set of a plurality of plays of a wagering game. If the player places the replay or modifier wager, the central server activates a replay or modifier feature which the player can selectively use or apply a designated number of times (such as one time) over the plurality of plays of the wagering game. When the player uses the replay feature for a play of the game, this causes the central server to redisplay that play of the wagering game and provide any award associated with that play of the wagering game to the player. Thus, when the player uses the replay feature for a play of the primary game, the player obtains a primary game award based on the primary game outcome which is determined by the gaming device processor, as well as a gaming system award based on the replay of the primary game. After the player uses the replay feature for each of the designated number of times, the player cannot use the replay feature for any remaining plays of the plurality of plays of the wagering game.

In one example embodiment, in the gaming system wagering event, the central server offers the player an opportunity to place a replay wager to obtain a replay feature that the player can use or apply one time over the next five plays of the wagering game. In one embodiment, the player makes the replay wager in addition to the primary game wagers that the player places on the next five plays of the primary game. The gaming device generates and displays a primary game outcome for a first play of the primary game. The generated primary game outcome for the first play of the primary game results in a primary game award of one hundred credits. The player chooses to apply the replay feature to this play of the game. Accordingly, the central server causes a replay of the primary game outcome and determines a gaming system award of one hundred credits. The central server causes the gaming device to update the credit meter to reflect the gaming system award of one hundred credits. Thus, the player wins a total award of two hundred credits in association with this play of the primary game. Since the player has used the replay feature the designated number of times (i.e., one time), the central server deactivates the replay feature. The player continues playing the remaining four plays of the primary game, but the player cannot use the replay feature for any of the remaining four plays of the wagering game.

In an alternative embodiment, instead of a replay feature, the gaming system wagering event offers the player one or more opportunities to place a gaming system wager to obtain one or more modifiers or multipliers that the player can selectively use or apply to one (or at least one) play of the wagering game.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system central server comprising:

at least one memory device; and at least one processor configured to operate with the at least one memory device to:

(a) receive from a gaming device first data including primary game configuration data for a play of a primary game;

(b) evaluate the first data and, if the first data meets a designated condition, determine at least one gaming system wagering opportunity for a gaming system wagering event, each said gaming system wagering opportunity associated with a respective gaming system wager;

(c) send second data to cause the gaming device to display the at least one gaming system wagering opportunity of the gaming system wagering event to a player of the gaming device before a primary game outcome is displayed to the player;

(d) receive third data regarding a player selection of one of the at least one displayed gaming system wagering opportunity and place the gaming system wager associated with any selected gaming system wagering opportunity;

(e) if the player selects one of the at least one displayed gaming system wagering opportunity and places the gaming system wager associated with the selected one of the at least one gaming system wagering opportunity, send fourth data to cause the gaming device to deduct a number of credits from a credit meter based on the placed gaming system wager;

(f) receive from the gaming device fifth data including primary game outcome data;

(g) if the player placed one of the gaming system wagers, determine a gaming system outcome;

(h) utilize the fifth data and the determined gaming system outcome to determine a gaming system award; and (i) send sixth data to cause the gaming device to display any determined gaming system award to the player and to add any additional credits owed to the player based on said determined gaming system award to the credit meter.

2. The gaming system of claim 1, wherein the primary game configuration data for the play of the primary game includes information relating to one or more of: (i) a type of primary game, (ii) a time the primary game is initiated, (iii) a wagering denomination, (iv) a number of activated paylines, and (v) an amount wagered per payline.

3. The gaming system of claim 1, wherein the primary game configuration data for the play of the primary game includes information relating to a primary game wager placed by the player on the play of the primary game, and wherein said designated condition includes the primary game wager meeting a designated wager level.

4. The gaming system of claim 1, wherein the at least one processor is configured to determine which at least one gaming system wagering opportunity to prepare for the gaming system wagering event based on the primary game configuration data for the play of the primary game.

5. The gaming system of claim 1, wherein the at least one processor is configured to interrupt the play of the primary game to cause the gaming device to display the at least one gaming system wagering opportunity of the gaming system wagering event to the player.

6. The gaming system of claim 1, wherein the primary game outcome data includes a primary game outcome and any primary game award associated with said primary game outcome for the play of the primary game.

7. The gaming system of claim 1, wherein the primary game includes any wagering game made by any of a plurality of different manufacturers.

8. The gaming system of claim 1, wherein the primary game configuration data for the play of the primary game includes information relating to a primary game wager placed by the player on the play of the primary game, and wherein said designated condition includes the primary game wager meeting a designated wager level for a certain denomination.

9. The gaming system of claim 1, wherein the gaming system outcome includes a gaming system modifier.

10. The gaming system of claim 9, wherein the gaming system modifier includes a multiplier.

11. The gaming system of claim 1, wherein the gaming system wagering event includes a plurality of gaming system wagering opportunities.

12. A gaming system comprising:

a gaming device including:

(i) at least one gaming device processor, (ii) at least one display device, and (iii) at least one input device; and at least one central server configured to operate with said gaming device to:

(a) receive from the gaming device first data including primary game configuration data for a play of a primary game;

(b) evaluate the first data and, if the first data meets a designated condition:

(i) before a primary game outcome is displayed:

(A) determine at least one gaming system wagering opportunity for a gaming system wagering event, each said gaming system wagering opportunity associated with a respective gaming system wager;

(B) send second data to cause the gaming device to display the at least one gaming system wagering opportunity of the gaming system wagering event to a player of the gaming device;

(C) receive third data regarding a player selection of one of the at least one displayed gaming system wagering opportunity and place the gaming system wager associated with any selected gaming system wagering opportunity; and (D) if the player selects one of the at least one displayed gaming system wagering opportunity and places the gaming system wager associated with the selected one of the at least one gaming system wagering opportunity, send fourth data to cause the gaming device to deduct a number of credits from a credit meter based on the placed gaming system wager; and (ii) after the primary game outcome is generated:

(A) receive from the gaming device fifth data including primary game outcome data;

(B) if the player placed one of the gaming system wagers, determine a gaming system outcome;

(C) utilize the fifth data and the determined gaming system outcome to determine a gaming system award; and (D) send sixth data to cause the gaming device to display any determined gaming system award to the player and to add any additional credits owed to the player based on said determined gaming system award to the credit meter.

13. The gaming system of claim 12, wherein the primary game configuration data for the play of the primary game includes information relating to one or more of: (i) a type of primary game, (ii) a time the primary game is initiated, (iii) a wagering denomination, (iv) a number of activated paylines, and (v) an amount wagered per payline.

14. The gaming system of claim 12, wherein the primary game configuration data for the play of the primary game includes information relating to a primary game wager placed by the player on the play of the primary game, and wherein said designated condition includes the primary game wager meeting a designated wager level.

15. The gaming system of claim 12, wherein the central server is configured to determine which at least one gaming system wagering opportunity to prepare for the gaming system wagering event based on the primary game configuration data for the play of the primary game.

16. The gaming system of claim 12, wherein the primary game outcome data includes a primary game outcome and any primary game award associated with said primary game outcome for the play of the primary game.

17. The gaming system of claim 12, wherein the primary game includes any wagering game made by any of a plurality of different manufacturers.

18. The gaming system of claim 12, wherein the primary game configuration data for the play of the primary game includes information relating to a primary game wager placed by the player on the play of the primary game, and wherein said designated condition includes the primary game wager meeting a designated wager level for a certain denomination.

19. The gaming system of claim 12, wherein the gaming system outcome includes a gaming system modifier.

20. The gaming system of claim 19, wherein the gaming system modifier includes a multiplier.

21. The gaming system of claim 12, wherein the gaming system wagering event includes a plurality of gaming system wagering opportunities.

22. The gaming system of claim 1, wherein the primary game has a primary game paytable having a first average expected payback, and wherein if the player selects one of the at least one gaming system wagering opportunity of the gaming system wagering event to obtain the gaming system outcome, an overall average expected payback associated with the play of the primary game is different than the first average expected payback.

23. The gaming system of claim 12, wherein the primary game has a primary game paytable having a first average expected payback, and wherein if the player selects one of the at least one gaming system wagering opportunity of the gaming system wagering event to obtain the gaming system outcome, an overall average expected payback associated with the play of the primary game is higher than the first average expected payback.

24. The gaming system of claim 12, which includes a plurality of gaming devices, wherein for each of said gaming devices, said at least one central server is configured to operate with said gaming device to execute (a) to (b).

* * * * *

UNITED STATES PATENT AND TRADEMARK OFFICE

CERTIFICATE OF CORRECTION

PATENT NO. : 8,308,549 B2
APPLICATION NO. : 12/271325
DATED : November 13, 2012
INVENTOR(S) : Anthony J. Baerlocher et al.

It is certified that error appears in the above-identified patent and that said Letters Patent is hereby corrected as shown below:

IN THE CLAIMS

In Claim 12, Column 37, Line 55, after “game;” insert --and--.

Signed and Sealed this
Fourteenth Day of May, 2013

Teresa Stanek Rea
*Acting Director of the United States Patent and Trademark Office*